US007040406B2

(12) United States Patent
Dore et al.

(10) Patent No.: US 7,040,406 B2
(45) **Date of Patent: *May 9, 2006**

(54) SUBSEA RISER DISCONNECT AND METHOD

(75) Inventors: Eddie E. Dore, Sugarland, TX (US); Britt O. Braddick, Houston, TX (US)

(73) Assignee: TIW Corporation, Houston, TX (US)

( * ) Notice: Subject to any disclaimer, the term of this patent is extended or adjusted under 35 U.S.C. 154(b) by 324 days.

This patent is subject to a terminal disclaimer.

(21) Appl. No.: 10/382,762

(22) Filed: Mar. 6, 2003

(65) Prior Publication Data

US 2004/0173356 A1 Sep. 9, 2004

(51) Int. Cl.
*E21B 29/12* (2006.01)

(52) U.S. Cl. ..... 166/338; 166/350; 166/359

(58) Field of Classification Search ..... 166/338, 166/339, 340, 341, 344, 350, 353, 359, 363, 166/356; 175/5–7; 285/18, 34
See application file for complete search history.

(56) References Cited

U.S. PATENT DOCUMENTS 3,241,864 A * 3/1966 Shaffer ..... 285/18
3,488,031 A * 1/1970 Taylor, Jr. et al. ..... 251/148
4,234,047 A * 11/1980 Mott ..... 175/5
4,307,902 A * 12/1981 Schnatzmeyer ..... 285/3
4,411,455 A * 10/1983 Schnatzmeyer ..... 285/39
4,436,157 A * 3/1984 Brooks ..... 166/344
4,593,937 A * 6/1986 Schawann et al. ..... 285/18
4,732,214 A * 3/1988 Yates ..... 166/336
5,685,373 A * 11/1997 Collins et al. ..... 166/313
6,557,637 B1 * 5/2003 Dore et al. ..... 166/338

* cited by examiner

*Primary Examiner*—Thomas A Beach
(74) *Attorney, Agent, or Firm*—Browning Bushman P.C.

(57) ABSTRACT

A subsea riser disconnect assembly 10 may be actuated from a drilling rig DR by axial movement of an upper riser 35 relative to a lower riser 28, for disconnecting the upper riser 35 from the lower riser 28. A subsea riser valve assembly 20 may be actuated from the drilling rig DR by axial movement of the upper riser 35 relative to the lower riser 28, for sealing an interior portion of the lower riser 28 and well bore WB below the subsea riser valve assembly 20. A drill pipe disconnect 30 may be actuated from a drilling rig DR, either onshore or offshore, for disconnecting an upper portion of drill pipe 236 from a lower portion of drill pipe 240. The drill pipe disconnect 30 may be actuatable by hydraulic and/or mechanical forces applied to the drill pipe disconnect 30 from the drilling rig DR. The drill pipe disconnect 30 may be compatible for use with or without the subsea riser disconnect assembly 10 and/or the subsea riser valve assembly 20. The component assemblies of this invention may improve the efficiency and lower the cost of recovering hydrocarbons by reducing drilling costs and time requirements. Also, the ability to relatively quickly disconnect a floating rig from a well may enhance the safety of persons and equipment facing hostile weather conditions or other emergency situations.

50 Claims, 9 Drawing Sheets

SUBSEA RISER DISCONNECT AND METHOD

FIELD OF THE INVENTION

The present invention relates to drilling subsea wells, and typically from a floating drilling rig. More particularly, this invention relates to a subsea riser disconnect equipment and techniques for sealingly connecting a lower riser extending downward into and fixed within a subsea well bore with an upper riser extending downward from the floating drilling rig, such that the upper riser may be disconnected from the fixed lower riser during adverse weather or other rig move-off conditions.

BACKGROUND OF THE INVENTION

Subsea wells are increasingly important to hydrocarbon recovery operations. Numerous land-based wells have been drilled, but the percentage of hydrocarbons recovered from land-based wells is steadily decreasing in some parts of the world. Jack-up rigs have been used offshore for decades to drill wells subsea to recover oil, but jack-up rigs are practically limited to drilling operations in relative shallow water of several hundred feet. As water depth increases other drilling rig options may be required to facilitate drilling and well completion operations. In addition to an increase in the number of off-shore wells being drilled, in more recent years an increasing number of wells are being drilled in deeper water and at increasing costs. Accordingly, drilling from offshore rigs, e.g., drilling ships, semi-submersibles, jack-ups, drilling barges or submersible rigs has significantly increased in recent years. The economics associated with drilling offshore remains, however, a primary reason why more wells are not drilled offshore. Particularly, in drilling exploratory wells where financial risk and commercial hydrocarbon uncertainty may severely impact the economics for drilling such wells, costs and may be more critical in determining whether any wells are drilled at all, and how many may be drilled.

The majority of offshore or marine drilling rigs utilize riser sections as the outermost tubular between the rig and the seafloor, with the riser sections typically being bolted, clamped, mechanically fixed by dog-type latch mechanisms or otherwise connected. Riser sections conventionally include hydraulic lines spaced outwardly of the assembled riser pipe for operating the blow out preventer (BOP) and subsea ram stack located above the mud line. During an emergency or in anticipation of adverse weather conditions, the subsea BOP may be closed and the rams hydraulically activated to seal off the well bore. Prior to closing the rams, the drill pipe may be threadably disconnected above or below the BOP stack utilizing a back off tool or back off method, or the drill pipe may be sheared by the shear ram assembly. In some applications, acoustically or electrically activated subsea accumulators have been used to replace the hydraulic lines which commonly are run along side the riser pipe. The subsea BOP stack assembly used during deep water drilling operations may contribute significantly to the cost of drilling a well and a substantial amount of expensive rig time may be expended running in and removing the riser pipe sections and related well control equipment.

The above disadvantages associated with drilling from floating drilling rigs have long been known. Accordingly, some drilling or operating companies may recommend "riser-less drilling" for certain deep water applications. A subsea pump may be provided to return the drilling fluid to the surface in a separate flow line. Riser-less drilling still has to contend with the high cost of the BOP stack and hydraulic operation of this equipment. Several wells have been successfully drilled from a floating drilling rig, while using a riser, wherein the BOP is placed on the drilling rig rather than subsea. To date, however, these wells practically are limited to geographic areas where and/or seasons when there is a reduced likelihood of adverse weather conditions which would require the floating drilling rig to relatively quickly disengage a portion of the riser, e.g., an upper riser from the lower riser. In these applications, however, elimination of the subsea BOP stack may result in significant cost savings when drilling a well. Further savings may be realized by using conventional threaded casing for a riser rather than flange-type riser pipe sections. Less area on the drilling vessel is required to store casing having the same nominal diameter as the riser pipe sections since conventional riser pipe sections include both flanges and hydraulic lines which are eliminated when using casing as the riser.

Typically, subsea BOP stacks are installed on the riser string. The BOP stack may be required to provide a subsea method of isolating a lower portion of the riser and well bore from the riser above the BOP stack. Stress in the riser typically includes the weight of the riser and the weight of the subsea BOP. Subsea BOP stacks may weigh in excess of 400,000 pounds. The weight of the BOP stack plus the weight of a riser sufficiently strong enough to deploy such stack and meet operational requirements necessitates that risers are inherently heavy pieces of equipment which may exert high levels of stress and strain on the drilling and on the riser sections. These effects may be even more pronounced in deep water applications. In deep water installations, installation of a typical riser system may require calm weather and well in excess of a week to install, and in excess of a week to retract. In addition to the subsea riser and BOP stack, electrical and hydraulic umbilical lines are typically deployed concurrently, to control and operate the BOP stack, choke and kill line valves, and hydraulic disconnects if present. Deployment and recovery of this equipment and the rig time involved all contribute significantly to well costs, as daily rental rates for semi-submersible drilling rigs may exceed $240,00 per day. Premature disconnection of a portion of the riser can likewise be expensive and time consuming, such as may be necessary in advance of hostile weather conditions, broken mooring chain or slipping mooring anchor.

If drill pipe is in a well bore and it becomes necessary to seal the interior of the well bore, pipe rams or shear rams in the BOP stack may be closed on the drill string to confine pressure and fluid within the well bore. In the event it becomes necessary to disconnect an upper portion of the drill pipe from a lower portion of the drill pipe, the drill pipe may be unthreaded at a tool joint, or cut with a chemical cutter or explosive charge. If pipe is stuck, the free point may be estimated by a free point calculation technique. Each of these disconnect methods requires time to determine free points, deploy appropriate tools on wire line, such as a "string shot," a free-point tool, a chemical cutter or jet-shot explosive charge. Multiple attempts and re-calculations may be required. The process can be time consuming and frustrating and may still result disconnecting at an undesirable disconnect point. Reconnecting after disconnecting can be even more exasperating, time consuming and expensive, and even impossible.

Disadvantages of the prior art are overcome by the present invention. An improved method of drilling from a floating drilling rig is hereinafter disclosed. A subsea riser disconnect is provided for connecting and disconnecting a lower riser from an upper riser.

SUMMARY OF THE INVENTION

This invention provides means and equipment for relatively quickly, physically disconnecting a floating drilling rig from a subsea well in a manner that may be operationally and economically more efficient than prior art equipment and techniques. In the event hostile weather conditions, rig conditions or well conditions threaten the safety or operating capabilities of an offshore drilling rig or work over vessel, the rig or vessel may be disconnected and moved out of harms way. The rig may later return to the well location and reconnect to the disconnected members. This invention provides means and equipment for installing a riser system and well control system which may provide for a more cost effective offshore drilling and/or work over operations than is available under prior art. Such improvements may reduce the costs to find, develop and produce hydrocarbons.

In one embodiment, this invention generally includes three primary components: a) a maritime or subsea riser disconnect for disconnecting and reconnecting an upper portion of the riser with a lower portion of the riser, b) a subsea riser valve for sealing off an interior of a well bore below the riser valve, and c) a drill pipe disconnect for disconnecting and reconnecting an upper portion of the drill pipe with a lower portion of the drill pipe.

Subsea Riser Disconnect

A preferred embodiment of a subsea riser disconnect includes an apparatus and means which disconnects an upper portion of the subsea riser from a lower portion of the riser, through axial movement of the upper riser relative to the lower riser. The upper riser and the lower riser may be collectively referred to as a riser system. The subsea riser disconnect may be positioned at substantially any point within the riser system, e.g., between the drilling rig and the mud line. The subsea riser is preferably accessible to either a remotely operated vehicle (ROV) or a diver, in order that a riser disconnect lockout device may be operated if needed. The subsea riser disconnect may facilitate placing the blow out preventer and well control stack (BOP) either on the rig or suspended from but relatively near the rig.

A preferred embodiment of a riser disconnect may include a male disconnect member secured to the lower end of the upper riser, and a female disconnect member secured to the upper end of the lower riser. The male disconnect member may include a seal mandrel and seal elements for providing a hydraulic seal between the male disconnect member and female disconnect member. The male disconnect member may also include a collet mechanism to facilitate latching and unlatching the male and female disconnect members. A lockout device may be included to prevent inadvertent actuation of the subsea riser disconnect, such as during initial installation of the riser disconnect and riser system. Manipulation of the lockout may be externally performed, such as by ROV, diver or otherwise.

The female riser disconnect member may include a seal bore receptacle for sealingly receiving the seal mandrel within the seal bore receptacle, and a circumferential collet groove may be included in an inner surface of the female riser disconnect for engaging collet dogs. A conical shaped entry guide may be included on an upper end of the lower riser disconnect member to guide the male disconnect member into the female disconnect member during subsea connection of the male and female disconnect member.

Manipulation of the riser disconnect latch may be performed by axial motion or reciprocation of the upper riser relative to the lower riser. (The terms "axial reciprocation, reciprocation, axial motion, axial, or similar variations of these terms, as used herein may be defined to be substantially synonymous, and include linear displacement of a first component relative to a second component, substantially along a common linear axis, in a first direction and/or second direction, but not necessarily consecutively in both directions during a single manipulation period.) The latching collet mechanism of the riser disconnect may be manipulated between the collet latch position and the collet unlatch position by alternately applying tension and releasing tension in the riser disconnect by the drilling rig.

In an initial installation, the riser latch mechanism, including the collet mechanism, may be positioned in the collet latch position. After the riser system is installed and cemented in position within the well bore, tension may be applied to the riser system at the riser disconnect to securely retain the latched engagement between the male and female disconnect members.

To disconnect the male and female disconnect members, such as in advance of an approaching storm, tension in the riser disconnect may be relaxed allowing the male disconnect member to move axially downward relative to the female disconnect member, thereby unlatching the collet mechanism. The upper riser may be subsequently raised, separated from and suspended above the lower riser. The rig may then be moved and/or the upper riser recovered to the rig.

To reconnect the riser disconnect, the male disconnect member may be guided by the entry guide into engagement with the female disconnect member and the collet mechanism re-latched. Tension may be applied and maintained in the riser system to retain the latched configuration during operations until it is desirable to again disconnect the riser disconnect system. Upon completion of well work operations, the female disconnect member with the male disconnect member (plus a subsea riser valve, if run) may be typically recovered together by normally cutting the riser below the mud line with either an explosive charge, a chemical cutter or a mechanical cutter.

If desired, the riser disconnect and lower riser may be drilled into position in the sea bed while the well bore for the lower riser is being drilled. This may be accomplished by a number of means, for example preferably by positioning the lower riser on the sea bed with a riser disconnect and portions of an upper riser attached or to be attached substantially during drilling operations, and running a string of drill pipe, a drill bit and/or an under reamer bit through the deployed riser assembly and rotating the riser string with the bit while drilling the lower riser into the seabed. Alternatively, the drill string may substantially swivel or rotate within the riser while the riser may not rotate or may rotate independently from the drill string, while drilling the lower riser into the sea bed for cementing and permanent placement of the lower riser. The drill bit and drill string may then be retrieved back to the rig. Those skilled in the art of well drilling operations will appreciate that there are a number of other means for drilling in the lower riser. An alternative embodiment for the riser disconnect provides non-rotational engagement grooves in order to rotate the riser with the drill string.

In an another alternative embodiment, the upper riser may include the female disconnect member and related components, while the lower riser provides the male disconnect member and related components. An alternative embodiment may also provide the seal members within the female member while the male seal member provides a substantially smooth sealing surface on a mandrel.

It is an object of the present embodiment to improve the economics of drilling, completion and work over operations from an offshore rig by providing a more economical method of equipment optimization and use. An embodiment provides apparatus and means for placing the wellhead and BOP system substantially on the rig. In a preferred installation, a riser system may be utilized which employs riser joint connections secured by means and apparatus other than by flanges and bolting, such as a threaded riser consisting of joints of well casing, or a groove locked connection. Such equipment usage and arrangement may also save a considerable amount of time in retracting and deploying the upper riser. In addition, a flex joint may be provided either above or below the riser disconnect to accommodate riser angular displacement.

It is also an object of this embodiment to provide apparatus and means to relatively quickly disconnect an upper riser from a lower riser to facilitate moving the rig out of harms way. This embodiment provides a riser disconnect system which may be actuated by merely reciprocating the upper riser relative to the lower riser.

It is further an objective of this embodiment to provide a riser disconnect apparatus which may be easily and reliably manipulated from the rig. Manipulation of the riser disconnect between the riser latch position and the riser unlatch position may be performed by simple axial reciprocation of the riser disconnect from the rig. Moving the BOP stack near the rig may also assist in economic riser deployment and recovery.

It is a feature of this preferred embodiment to provide a riser disconnect system which may be reconnected after disconnecting the male and female disconnect members. The riser disconnect system of this embodiment may be repeatedly connected and disconnected.

It is another feature of this embodiment that the riser disconnect may be manipulated between the connected and disconnected positions without subsurface hydraulic and/or electrical umbilical lines. Although such lines may optionally be employed for other purposes, the riser disconnect does not require them.

It is also a feature of this embodiment that the riser disconnect system may be locked in the riser latch or unlocked from the riser latch position. The riser system, including the riser disconnect may be installed while the riser disconnect is locked in the latched position, and after installation the riser disconnect may preferably remain unlocked, while riser tension maintains the disconnect in a latched configuration.

These advantages may enhance deep water operations by facilitating employment of an improved, more cost effective riser and drilling system which may save considerable time and costs. The subsea riser disconnect may provide for placing the BOP stack on or suspended just below the rig or drill ship, thereby effectively eliminating placing the BOP stack on the ocean floor. By minimizing the number of subsurface hydraulic and electric umbilical lines, connectors, and kill and choke lines, several days of rig time may be saved. The preferred drilling equipment configuration and alternative embodiments thereof, as disclosed herein, may be particularly applicable for drilling and completing exploratory or other wells where well costs are a key consideration and where the well may not be intended for production after well testing.

It is also a feature of this embodiment that the riser disconnect system may be employed with re-entry risers as well as drilling and completion risers. Although the preferred embodiment is illustrated generally in terms of use with a drilling riser installation, the concepts and apparatus for riser disconnect manipulation by axial reciprocation methods may be applied equally well to risers used in completion and re-entry operations following well completion.

Subsea Riser Valve

A preferred embodiment of a subsurface riser valve includes an apparatus and methods for sealing the interior of a well bore, below the riser valve, through axial movement of the riser above the riser valve (generally, the upper riser) relative to the riser below the riser valve (generally, the lower riser). The subsea riser valve may be positioned at substantially any point along a riser system, preferably below the riser disconnect such that the riser valve may be closed in conjunction with or prior to disconnection of a riser disconnect. The subsea riser valve may also provide a subsea method of well control, such that the BOP stack may be positioned on the rig.

A preferred embodiment of the subsurface riser valve provides for the riser valve as a distinct, stand-alone piece of equipment which may be employed separately or in combination with riser and/or drill pipe disconnect apparatus. The riser valve is preferably used in combination with the riser disconnect, such that the riser valve is positioned below the riser disconnect in order that the interior of a lower riser and well bore below the riser valve may be hydraulically isolated and confined. The lower end of a riser valve may be sealingly connected to the upper end of a lower riser, a well casing, a well head or other subsea component. The upper end of the subsea riser valve may be directly or indirectly secured to the lower end of the subsea riser disconnect.

The subsea riser valve includes a valve housing enclosing a valve sealing member, and a valve actuation mandrel telescopically extending from the upper portion of the riser valve. A linkage or connector may moveably connect the valve sealing member and the valve actuation mandrel. The riser valve may be biased closed and may be opened in response to axial tension in the riser system. A lockout device similar to the lockout device described on the riser disconnect above, may be included with the riser valve apparatus, to lock the riser valve in either the valve opened or valve closed positions.

The riser valve may be locked in the opened position during installation of the riser system to allow the riser to fill with fluid and to allow circulation of fluids or slurries through the string prior to applying tension in the valve system. When the riser valve and riser system are properly positioned, installed and cemented, tension may be exerted on the riser valve to maintain the valve sealing member in the valve opened position. Prior to closing the valve sealing member, components within the through bore of the riser valve may be removed from within the through bore of the riser valve, such that the valve sealing member may freely move between the valve closed and valve opened positions.

It is an objective of this embodiment to provide an apparatus and means for sealing the interior of a riser and well bore below the riser in response to axial motion of the upper riser string. To close an opened valve sealing member, axial tension in the riser system may be relaxed such that the weight of the riser and the resulting closing biasing force may close the riser valve, effectively sealing the well bore below the riser valve. To open the riser valve, axial tension may be applied to the upper riser and valve actuation mandrel sufficient to overcome the riser weight and closing bias force. The riser valve may be opened and closed repeatedly as needed during well operations.

It is an object of this embodiment that the riser valve may be used in conjunction with the riser disconnect to provide a mechanically actuated riser disconnect and well control system for connecting a drilling rig to a subsea well bore. Such mechanically actuated system may assist in facilitating placing the BOP stack and related well control equipment on or near the drilling rig. Such arrangement may significantly decrease well costs by eliminating hydraulic and/or electrical umbilical lines between subsea equipment and the rig. Concurrent and subsequent axial movement of the riser may also unlatch and disconnect the upper riser from the lower riser. The rig and upper riser may thereafter be removed from the situs of the well, while the subsea well control valve remains to contains well pressure and fluids within the well bore.

It is also an object of this embodiment to provide a subsea riser valve which may be manipulated between the opened and closed positions without hydraulic or electrical lines. Mechanical movement within the valve mechanism is provided by axial movement of the riser system, thereby effectively eliminating the need for hydraulic or electrical actuation of the valve sealing member.

It is a feature of this embodiment that the riser valve provide a full bore opening through bore. The preferred riser valve, including the valve sealing member may provide an ID that is not less than the minimum ID of either or both of the upper riser and lower riser.

It is another feature of this embodiment that the preferred riser valve may be provided as a separate, stand alone device, such that the riser valve may be used alone in a riser system, or a riser disconnect may be combined with a stand-alone riser valve and/or other separate devices. Alternatively, the riser valve may be integrated into a common housing with a riser disconnect apparatus. Both apparatus may be compatible for use as an integrated tool combining both the riser valve and the riser disconnect in a common housing or body, as both may be compatibly manipulated by axial tension applied at the drilling rig.

It is also a feature of this embodiment that the riser valve may be installed inverted from the preferred orientation described above, such that the valve actuation mandrel is connected to the lower riser, casing or well head. In either the preferred or an inverted embodiment, the riser valve may be manipulated with tension in the upper riser.

An additional feature of other embodiments of this invention is that the riser valve components may be varied such that the valve sealing member may be of a type other than a ball type sealing member, such as plug type rotational cylinder members, or gate type sealing members, or flapper type sealing members. Alternative embodiments for a riser valve may be configured for manipulating each of these types of sealing members from axial movement of the upper riser relative to the lower riser.

Drill Pipe Disconnect

Apparatus and method are disclosed for connecting and disconnecting an upper portion of a drill pipe string above a drill pipe disconnect apparatus from a lower portion of a drill pipe string below the disconnect apparatus. The drill pipe disconnect may be positioned at substantially any point along the drill string wherein it may be convenient or desirable to disconnect a portion of the drill pipe string from the remainder of the string. Such disconnection may be required in conjunction with disconnecting a subsea riser disconnect, and/or in conjunction with closing a subsea riser valve, such as may be desirable in advance of relocating the rig due to approaching threatening weather.

The drill pipe disconnect is preferably used in conjunction with the subsea riser disconnect and/or the subsea riser valve. Prior to closing a riser valve and/or disconnecting a riser disconnect, rather than pull the entire string of drill pipe above the riser valve, it may be prudent to temporarily abandon the portion of the drill pipe string which is below the riser valve and the drill pipe disconnect. In such event, the drill pipe disconnect may be disconnected at a point below the riser valve, and the upper disconnected portion of drill pipe pulled up to above the riser valve, such that the riser valve may be closed and the riser disconnect subsequently disconnected.

The drill pipe disconnect may be selectively operable to mechanically disconnect or connect the upper and lower portions of a drill pipe string, in response to movement of a latch mechanism, while also providing axial and rotational strength commensurate with the strength of the drill pipe in use. Non-rotational engagement components may be included within the drill pipe disconnect to carry rotational stresses in the drill string.

A preferred embodiment of a drill pipe disconnect apparatus may generally include a male drill pipe disconnect member and a female drill pipe disconnect member. The male disconnect member may include a collet mechanism to latch and unlatch the male and female disconnect members. A latch sleeve may be included, which is movable between a collet latch position and a collet unlatch position. When the latch sleeve is in the collet unlatch position, the male drill pipe disconnect member may be released from engagement with the female drill pipe disconnect member.

The male and female disconnect members of the drill pipe disconnect may be secured within a drill pipe string by connections provided on each end of the drill pipe disconnect. In a preferable embodiment, the upper end of the male disconnect may include a threaded box type tool joint, while the lower end of the female disconnect may include a threaded pin type tool joint.

A preferred method of operation for the drill pipe disconnect generally includes providing and operating a first assembly and a second assembly, which is a modification of the first assembly. The first assembly may typically be employed for an initial drill pipe disconnect installation. Thereafter, subsequent to disconnecting the drill pipe assembly and recovering the male drill pipe disconnect member to the rig, the second assembly may be installed. The second assembly is provided by substituting a male reconnect member for the male disconnect member, to reconnect the male reconnect member with the female disconnect member. Thereafter, if desired the male reconnect member and the female disconnect member may be re-unlatched from one another.

The first assembly for the drill pipe disconnect may be installed in a drill pipe string, such that the collet mechanism and latch sleeve are in the collet latch position. A shear pin may secure the position of the latch sleeve within a male disconnect housing, in the collet latched position. The string of drill pipe including the drill pipe disconnect may be repeatedly inserted into and withdrawn from a well bore as needed, such as when "tripping pipe," with the drill pipe disconnect apparatus threadably secured within the drill string.

In the event it becomes desirable to disconnect the drill pipe disconnect and temporarily or permanently abandon a lower portion of drill pipe within the well bore, an unlatching ball or other closure device may be dropped through the upper portion of drill pipe, from the rig floor. The unlatching ball may sealingly seat on the unlatching seat such that hydraulic pressure may be applied to the drill string from the rig to cause the latch sleeve to shear the shear pin and move downward to a position where the collet dogs may unlatch from engagement with the female disconnect member. The male drill pipe disconnect member may then be telescopically withdrawn from the female disconnect member, and the male disconnect member and upper portion of drill pipe withdrawn to the rig.

To reconnect the male disconnect member with the female disconnect member, the male second assembly of the male disconnect member may be provided with a positionable latch sleeve that includes two unlatch grooves, shear pins that provide for two shearing actions, a latching seat and an extension tube on the latch sleeve. The male disconnect member may subsequently be engaged with the female disconnect member in the well bore. A latching ball may then be dropped through the drill pipe string for sealingly seating on a latching seat in the latch sleeve. The latching seat may be secured within the latch sleeve by shear pins. Hydraulic pressure may be applied within the drill string, sufficient to shear the double shear pins at a first shear point. The latch sleeve may then move downward from a collet unlatch position to a collet latch position, such that the male and female disconnect members are again securely latched together.

Hydraulic pressure within the drill string may be further increased to until the shear pins which secure the latch seat within the latch sleeve are sheared, allowing the latch seat and latching ball to be ejected downward from within the latch sleeve. The extension tube on the latch sleeve may receive or catch the ejected latch seat and latching ball. The extension tube may provide a plurality of ports to hydraulically interconnect the upper and lower portions of the interior of the drill pipe. A hydraulic conduit is thereby provided through the drill pipe through bore such that fluid may be circulated through the upper and lower portions of the drill pipe string. The latch seat and latching ball may remain within the extension tube. As an alternative, instead of shearing the latch seat pins and ejecting the latch seat and latching ball and receiving the latch seat and latching ball within the extension tube, the latch ball may be recovered to the surface. Fluid may be circulated down the drill pipe/casing annulus and back up through the drill bit and drill pipe to reverse flow the latching ball back to the surface of the rig.

In the preferred embodiment, to re-unlatch the male drill pipe disconnect from the female drill pipe disconnect, a re-unlatching ball may be dropped for sealingly seating on a re-unlatching seat. Hydraulic pressure applied within the drill pipe through bore may shear the double shear pins at a second point and allow the latch sleeve to move downward to a re-unlatch position, wherein the male disconnect member may be withdrawn from the female disconnect member and recovered to the rig. For subsequent re-engagement, the male disconnect member may be again re-dressed as described above for reconnection.

The drill pipe disconnect apparatus and/or method may be utilized in either an off-shore installation or a land based installation. In a land based installation, the drill pipe disconnect may provide for a disconnect point in the drill pipe string, such as may be desirable to provide above a geologic trouble spot or near a casing seat above an open hole section. It may be desirable to provide a convenient disconnect device at a point in the drill string where backing off or disconnecting otherwise may be difficult or impossible to achieve, particularly in deep wells or along long horizontal well bore sections.

It is an object of this embodiment to provide a method of operation and an apparatus for disconnecting an upper portion of a drill pipe string from a lower portion of the drill pipe string in a quick, reliable manner. The preferred disconnect method and apparatus disclosed herein facilitates providing a relatively simple and reliable disconnection point within a drill pipe string. Some of the components and mechanisms relied upon for operation of this embodiment are recognized as generally reliable mechanisms, such as a collet mechanism, shear pinned components, and ball and seat type hydraulic seals.

It is also an object of this embodiment to provide a drill pipe disconnect apparatus and method which may be manipulated without relying upon back-off tools, back-off methods, external manipulation devices or destruction of drill pipe to disconnect. This embodiment provides method and apparatus for disconnecting an upper section of a drill pipe string from a lower section of the drill pipe string by dropping a ball and applying hydraulic pressure to unlatch a latch mechanism. The drill pipe disconnect can also be actuated with a portion of the drill string off the bottom of the well bore. To disconnect the drill pipe disconnect mechanism with the drill string off bottom of the well bore, disconnection may only require that a higher pressure be applied to the interior of the drill pipe string above the dropped ball.

It is a feature of this embodiment that an apparatus and method are provided for reconnecting the upper and the lower drill pipe sections after they have been disconnected. In this embodiment the upper and lower drill pipe sections may be re-engaged and then re-latched by dropping a ball and applying hydraulic pressure to securely re-latch the upper and lower drill pipe sections.

It is also a feature of this embodiment that the re-latched drill pipe sections may subsequently be unlatched again, thereby facilitating repeated disconnects and reconnects as desired. The drill pipe reconnect and disconnect apparatus and methods are simple and reliable to operate and may save time and costs in disconnecting a drill pipe string at a pre-determined location.

It is yet another feature of this embodiment that the drill pipe disconnect may provide an apparatus and method for rotating the drill string. Non-rotational engagement members are provided which may provide rotational strength within the disconnect apparatus which is substantially equivalent to the strength of the drill pipe.

DETAILED DESCRIPTION OF THE PREFERRED EMBODIMENTS

Figure 1:
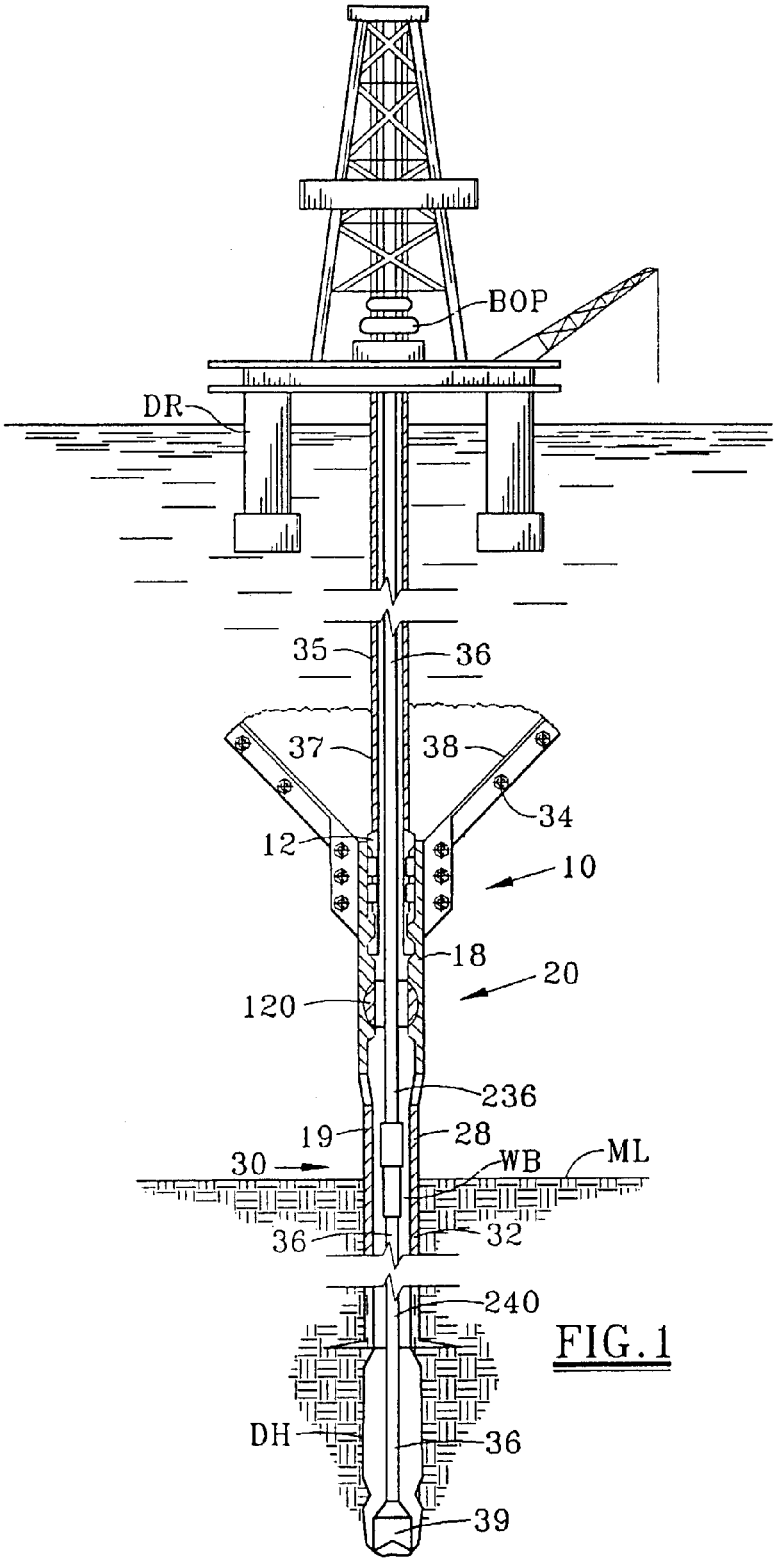
FIG. 1 is a simplified pictorial representation of a drilling rig, a riser assembly, a riser disconnect, a riser valve, a string of drill pipe, and a drill pipe disconnect in a drilling installation.
Figure 1A:
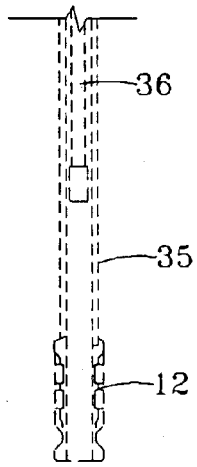
FIG. 1A is a pictorial illustration of a riser male disconnect member disconnected from a female riser disconnect member, with an upper portion of drill pipe disconnected from a lower portion of drill pipe.

FIG. 1 illustrates a generalized, suitable application for a subsea riser disconnect, a subsea riser valve and a drill pipe disconnect according to the present invention. In one embodiment, this invention includes three principle assemblies, namely: 1) a subsea riser disconnect assembly 10, 2) a subsea riser valve assembly 20, and 3) a subsea drill pipe disconnect assembly 30. Each of these three principle assemblies may be provided in a drilling installation, separate and apart from or in combination with any or both of the other principle assemblies, or primary components. As disclosed subsequently, safety mechanisms may be included within each principle assembly to prevent inadvertent operation of that assembly.

Each of these three primary components 10, 20, 30 may be employed individually or in conjunction with one or both of the other primary components. And each of these three components generally include a through bore extending through the component along a central axis 15. The central axis 15 may substantially be common to each and all components. (It is understood and assumed throughout this disclosure, that all seals may be both hydraulic seals and pneumatic seals, notwithstanding the fact that a particular seal may be simply designated as a hydraulic seal or otherwise. It is also understood and assumed that all connections, secured components, attachments or otherwise joining of two or more components may effect a seal, unless designated otherwise. It is further understood and assumed that the terms drilling rig, rig, work over rig, and drill ship, semi-submersible and related terms may be used interchangeably and not in limitation.)

One or more portions of a preferred embodiment of a sub-sea riser disconnect assembly 10 are illustrated in FIGS. 1, 1A, 2 and 3, for sealingly connecting a lower riser 28 extending downward from above the mud line ML through a seabed SB and into a subsea well bore WB with an upper riser 35 extending downward from a drilling rig DR to the lower subsea riser 28. The drilling rig DR may include floating types of drilling rigs DR such as a drill ship and a semi-submersible rig. The position of the drilling rig DR is not fixed with respect to the location of the wellbore WB. The lower subsea riser 28 may be secured within the wellbore WB, e.g., by a cementing operation, such that the riser disconnect assembly 10 may be selectively activated to disengage and/or reengage a lower end 37 of the upper riser 35 from an upper end 19 of the lower riser 28.

The subsea riser disconnect assembly 10, the subsea valve assembly 20, the drill pipe 36, the drill pipe disconnect 30 and the wellbore WB may each include a through bore and a central axis 15. Both the through bore and the central axis 15 may be substantially aligned along a common central axis 15.

The riser disconnect assembly 10 includes a male disconnect member 12, which may be secured to the lower end 37 of the upper riser 35, and has a central axis aligned along the axis 15. The riser disconnect assembly 10 also includes a female disconnect member 18 for axially receiving the male disconnect member 12 therein. The female disconnect member 18 may be secured to upper end 19 of the lower riser 28. The riser disconnect assembly 10 may provide a full bore opening, such that the minimum ID of the through bore of the riser disconnect assembly 10 is equal to or greater than the ID of at least one of the upper 35 and lower 28 riser sections. Those skilled in the art will appreciate that a riser may generally be comprised of tubular components having a common through bore for providing a conduit that connects a drilling rig DR with a downhole DH portion of a well bore WB that typically extends below the lower end of the riser, where a portion of the lower end of the riser is secured within the seabed, below the mud line ML.

Riser Disconnect Male Member

Figure 2:
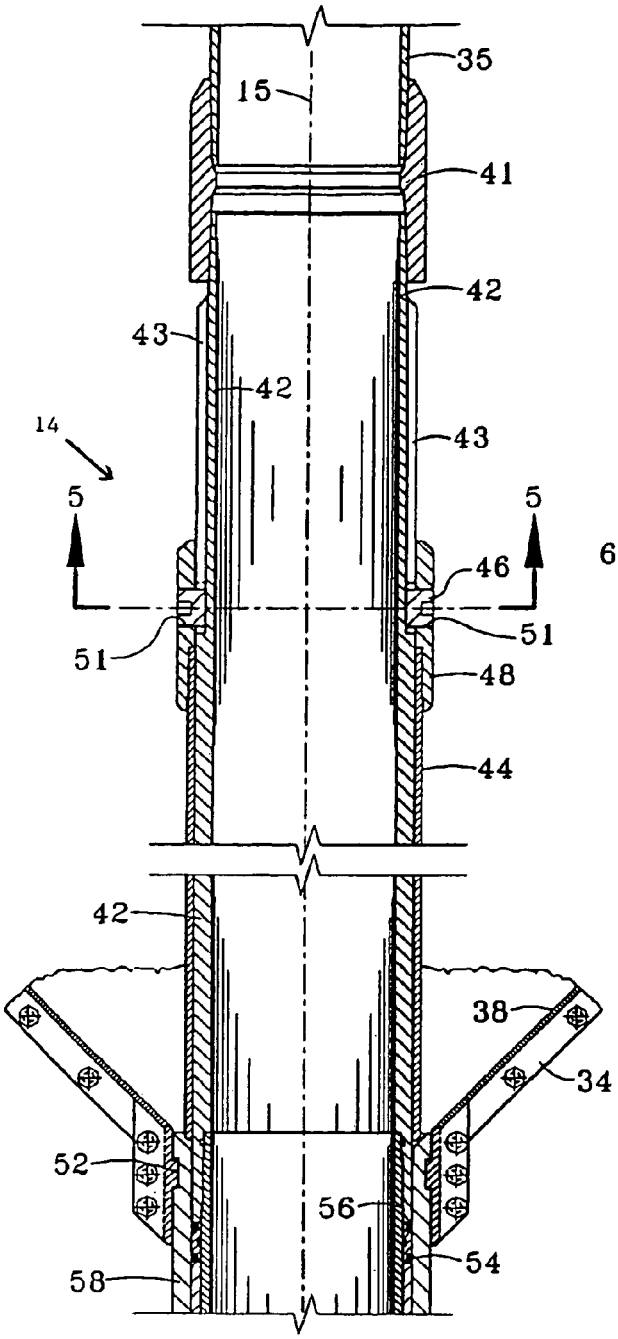
FIG. 2 is a cross-sectional view of an upper portion of a riser disconnect assembly illustrated in cross-section.
Figure 3:
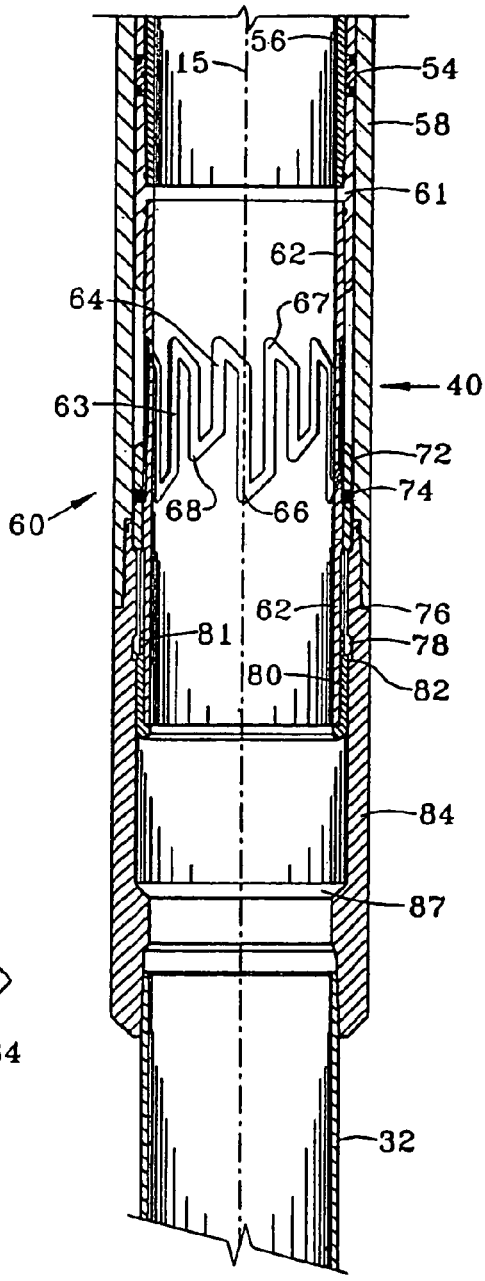
FIG. 3 is a cross-sectional view of lower portion of the riser disconnect assembly illustrated in FIG. 2.

As illustrated in FIGS. 1, 2 and 3, a seal assembly 14 may provide a pneumatic seal in the connection between the outer surface of the male disconnect member 12 and a mating inner surface of the female disconnect member 18.

The male component of the seal assembly 14 includes an upper seal mandrel 42, which may be connected to a lower end 19 of the upper riser 35 by a riser connector collar 41. A lower end of the upper seal mandrel 42 may be connected to an upper end of a lower seal mandrel 56. The lower end of the lower seal mandrel 56 in turn may be connected to a seal retainer 61, which may be connected to latch mandrel 62. The upper end of the latch mandrel 62 may be connected to the lower end of the seal retainer 61, while the lower end of the latch mandrel 62 may generally include the lower end of the male disconnect member 12. A commonly known latch J-slot groove 63, as shown in FIG. 3, may be included in the outer surface of the latch mandrel 62, and may circumferentially surround the latch mandrel 62, in either the pattern shown or another desired pattern.

One or more seal elements 54, also commonly known as packing elements, may be positioned axially along the outer surface of the lower seal mandrel 56, between the upper seal mandrel 42 and the seal retainer 61. The seal elements 54 may circumferentially encompass the outer surface of the lower seal mandrel 56 and may include an alternating arrangement of a variety of seal materials in alternative embodiments. The seal elements 54 need not be axially continuous along the lower seal mandrel 56, and may be positioned in sets, at axial intervals along the male component and female component. The female component of the seal assembly 14 may include a seal bore receptacle 58 for engaging the seal elements 54. The female disconnect member 18 is discussed in detail below.

A riser interconnection device 40 may be included for releasably securing the male disconnect member 12 with the female disconnect member 18. The riser interconnection device 40 may be actuatable in response to axial reciprocating movement of the upper riser 35 relative to the lower riser 28 from a connect position to a release position or from a release position to a connect position. This reciprocating movement may be effected by movement of the upper riser 35 at the drilling rig DR. In the release position, the male disconnect member 12 and the female disconnect member 18 may be uncoupled, thereby permitting mechanical separation of the upper riser 35 from the lower riser 28, as discussed below.

Figure 4:
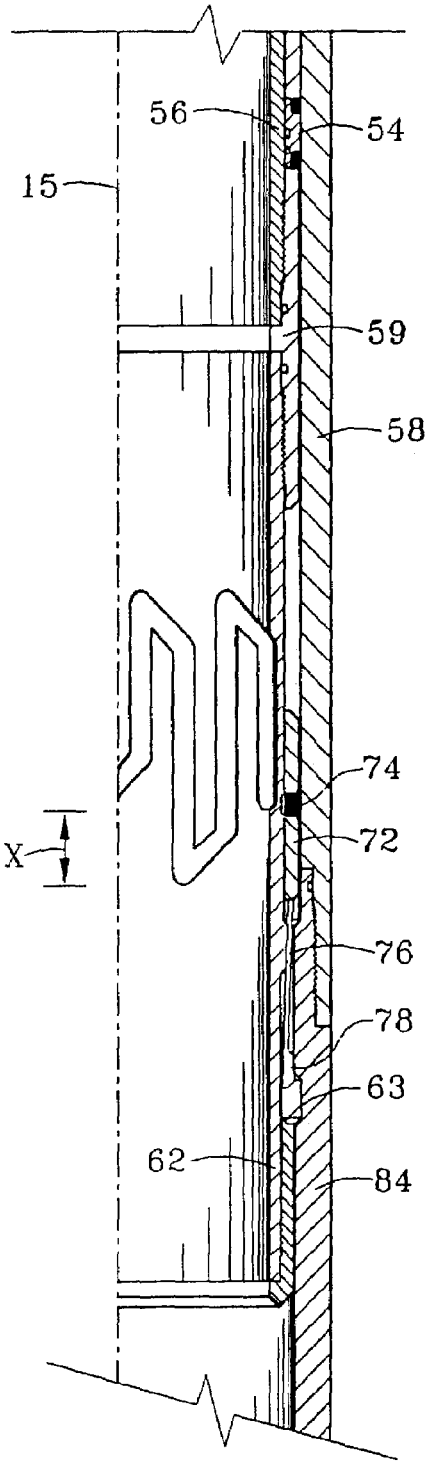
FIG. 4 is an enlarged half-section illustration of the riser disconnect collet mechanism generally illustrated in FIG. 3.

Referring to FIGS. 1 ,3 and 4, the riser interconnection device 40 may include a collet mechanism 60 for releasably interconnecting the male disconnect member 12 with the female disconnect member 18. Components of the collet mechanism 60 included in the male disconnect member 12 may include a collet latch sleeve 72, a latch pin 74 and the collet locking sleeve 80. The collet latch sleeve 72 may include a plurality of collet arms 76, and each collet arm 76 may include a collet dog 78 for engaging a collet groove 82. The collet groove 82 may be provided in the inner surface of a latch housing sleeve 84 of the female disconnect member 18. The collet latch sleeve 72, a plurality of collet arms 76 and corresponding plurality of latch dogs 78 may be circumferentially spaced about the external surface of the latch mandrel 62 for selectively interconnecting the plurality of collet dogs 78 with the collet groove 82. The collet latch sleeve 72, the plurality of collet arms 76 and the latch dogs 78 may be axially and rotationally moveable about the common central axis 15, with respect to the latch mandrel 62.

One or more latch pins 74 may be secured in the collet latch sleeve 72. The latch pins 74 may protrude radially inward from the inner surface of the collet latch sleeve 72 toward the central axis 15 for a distance sufficient for the latch pins 74 to engage the latch J-slot groove 63, in the outer surface of the latch mandrel 62. The intrusion of latch pins 74 into the J-slot groove 63 may not exceed the depth of the latch J-slot groove 63. The plurality of collet arms 76 and collet dogs 78 are preferably made integrally part of the collet latch sleeve 72. The plurality of collet arms 76 and collet dogs 78 extend downward from the collet latch sleeve 72. The collet locking sleeve 80 may be immovably secured to the lower end of the latch mandrel 62, below the collet latch sleeve 72.

A portion of the collet locking sleeve 80 may extend axially upward along the outer surface of the latch mandrel 62 for a sufficient distance such that, with the riser disconnect assembly 10 in the latched position, a tapered portion 81 of the collet locking sleeve 80 may be circumferentially positioned between an inner surface of the collet dogs 78 and an outer surface of the latch mandrel 62. The tapered portion 81 of the collet locking sleeve 80, which is between the inner surface of the collet dogs 78 and the outer surface of the latch mandrel 62, may also be referred to as the collet engaging ring 81. An outer surface of the collet engaging ring 81 includes the tapered surface which may taper upward to a circumferential upper edge. A load bearing shoulder at bottom of the collet dog 78 may be supported on load bearing shoulder at lower end of collet engaging ring 81 of collet locking sleeve 80 when the riser disconnect assembly 10 is in the latched position. A load bearing shoulder at top of the collet dog 78 may be supported on load bearing shoulder at upper end of a collet engagement groove 82 when riser disconnect assembly 10 is in the latched position.

Riser Disconnect Female Member

Referring to FIGS. 1, 2, 3 and 4, the lower riser 28 extends upward from the mud line ML, generally toward the drilling rig DR. The lower end of the lower riser 28 may be connected to a well casing 32 which extends through a seabed and into a subsea wellbore WB. The female disconnect member 18 may include the latch housing sleeve 84, a seal bore receptacle 58, and an entry guide 34. The latch housing sleeve 84 may also include the female portion of the collet mechanism 60, e.g., the collet groove 82 for coupling with the companion male components of the collet mechanism 60. A casing end of the latch housing sleeve 84 may be attached to the upper end of a well casing 32 or other component. A latch end of the latch housing sleeve 84 may include a collet groove 82 circumferentially within the inner surface of the latch housing sleeve 84 for releasably receiving and securing the collet dogs 78 of the male disconnect member 12.

The latch end of the latch housing sleeve 84 may be attached to the lower end of the seal bore receptacle 58. An entry guide 34 may be secured to an upper end of the seal bore receptacle 58, and may assist in aligning the male disconnect member 12 with the female disconnect member 18 during reconnection of the male disconnect member 12 and female disconnect member 18. An entry guide retainer 52 may be used to secure the entry guide 34 to the seal bore receptacle 58. The entry guide 34 may extend upward toward the water surface from the point of attachment to the female disconnect member 18, with a frustoconically expanding circumference, thereby forming a generally cone shaped receptacle defined by surface 38.

Riser Disconnect Lockout Mechanism

Figure 2A:
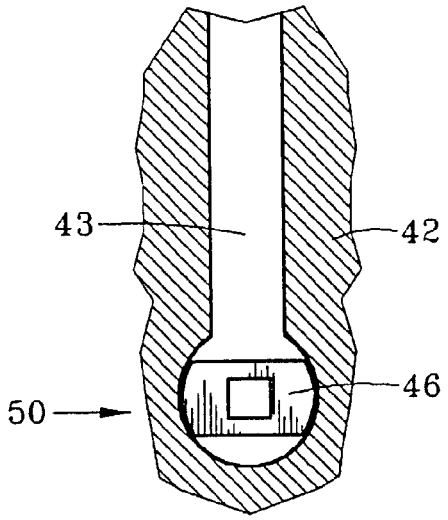
FIG. 2A is a side view of a riser disconnect lockout as shown in FIG. 2, in a locked orientation.

In addition to the latch mechanism and seal components, the riser disconnect assembly 10 may include a riser disconnect lockout 50 to prevent inadvertent or unintentional disengagement of the male disconnect member 12 from the female disconnect member 18. The riser disconnect lockout 50 may typically be used in the locked configuration only during the initial connection, installation and cementing of the upper and lower riser assembly, when compressive forces may be experienced due to running, installing and cementing the casing 32 and/or the riser disconnect assembly 10. The riser disconnect lockout 50 may otherwise normally remain in the unlocked position since the applied axial tensile forces in the upper riser 35 prevent disconnection of the male disconnect member and the female disconnect member. Referring to FIGS. 2, 2A, the riser disconnect lockout 50 may preferably be comprised of a shouldered pin and groove assembly. The riser disconnect lockout 50 preferably may be provided on the male disconnect member 12, axially between the riser connector collar 41 and the lower seal mandrel 56.

Figure 5A:
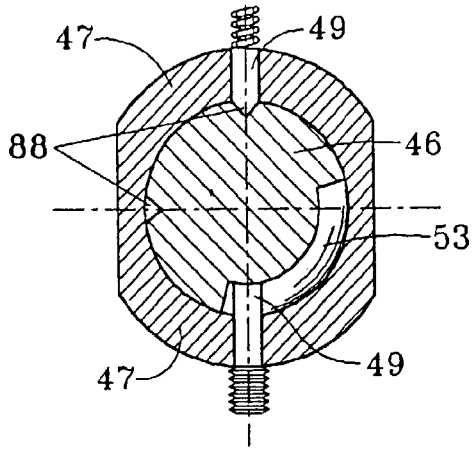
FIG. 5A is a side view of the riser disconnect lockout shown in FIG. 2, in cross-section through the lockout pin illustrating retainers, grooves and stop dimples.
Figure 3A:
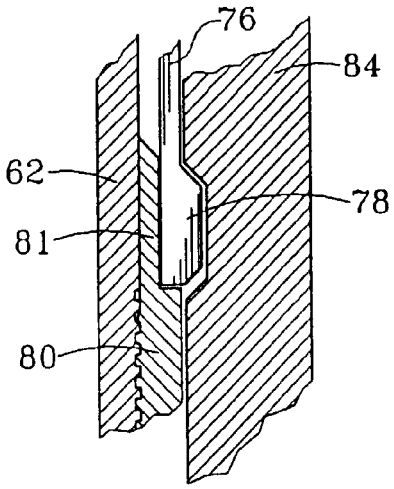
FIG. 3A is an enlarged view of a collet mechanism illustrating a collet mechanism in a latched position.
Figure 5:
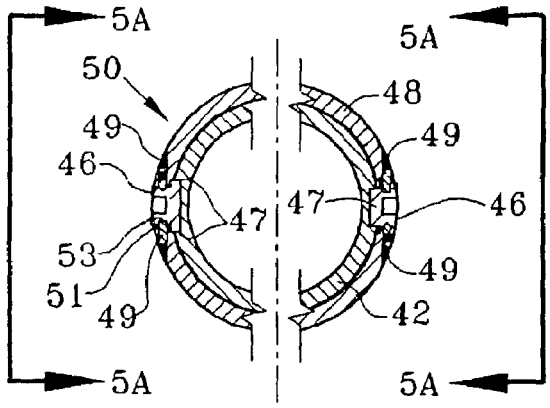
FIG. 5 is a cross-sectional view of a riser disconnect lockout wherein the left half of FIG. 5 illustrates the lockout mechanism in the locked orientation and the right half of FIG. 5 illustrates the lockout mechanism in the unlocked orientation.
Figure 6:
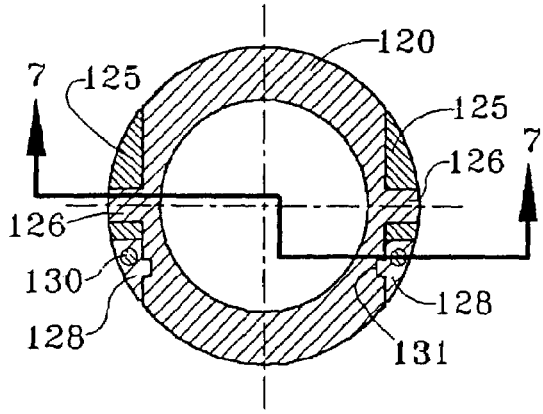
FIG. 6 is a cross-sectional top view of a riser valve assembly, illustrating a ball pivot and the ball linkage adapter.

Referring to FIGS. 1, 2, 2A, 3, 3A, 4, 5, 5A one or more lockout grooves 43 may be circumferentially provided on the outer surface of the upper seal mandrel 42, each lockout groove to accommodate a lockout pin 46. The one or more grooves 43 may each have a long axis which is aligned axially up and down along the upper riser 35, substantially parallel with the central axis 15. Each groove 43 includes a circular portion, at the lower end of the groove 43, the circular portion having a diameter that is larger than the width of the groove 43, as shown in FIGS. 2A and 5. A riser disconnect lockout housing 48 may be circumferentially positioned on the external surface of the upper seal mandrel 42, the riser disconnect lockout housing 48 being axially moveable along the central axis 15, on the outer surface of the upper seal mandrel 42.

A riser disconnect lockout pin 46 may be provided for each lockout groove 43. Referring to FIGS. 2A, 5, and 5A, the riser disconnect lockout pin 46 may include a round shaped upset providing lockout upset shoulders 45 and having two opposing flat sides where opposing portions of the round shaped upset are removed to provide the flat sides, on an inner end of the riser disconnect lockout pin 46, the rounded portion provided along a major axis between the rounded ends and having a length that is larger than the diameter of the pin 46, and a minor axis between the two flat sides which is substantially equal to the diameter of the pin 46. Each lockout pin 46 may extend from inside of the riser disconnect lockout housing 48, through a pin port 51 and may be furnished with a square socket for engagement with an ROV operating wrench (not shown). The round shaped portion of the riser disconnect lockout pin 46 remains inside of the riser disconnect lockout housing 48 in the respective lockout groove 43.

As illustrated in FIGS. 5, 5A, spring loaded and/or threaded or otherwise secured retainer pins 49 may be positioned within the riser disconnect lockout housing 48 to engage a retainer groove 53 in each lockout pin 46 to provide resistance to the pin 46. Such configuration may thereby prevent inadvertent rotation of the pin 46. In addition, the retainer groove 53 may only be provided circumferentially around a portion of the outer surface of the lockout pin 46, such as ninety degrees, in order to provide rotational stop positions to ensure proper rotational orientation of the lockout pin 46. Stop dimples 88, as shown in FIG. 5A, may be provided on a portion of the lockout pin 46 to ensure proper respective locked and unlocked lockout pin 46 orientation.

A lockout sleeve 44 may be concentrically disposed around a portion of the upper seal mandrel 42. An upper end of the lockout sleeve 44 may engage the riser disconnect lockout housing 48, and a lower end of the lockout sleeve 44 may engage the upper end of the seal bore receptacle 58. The lockout sleeve 44 is axially moveable with respect to the upper seal mandrel 42 when lockout 50 is in the unlocked position.

Figure 18:
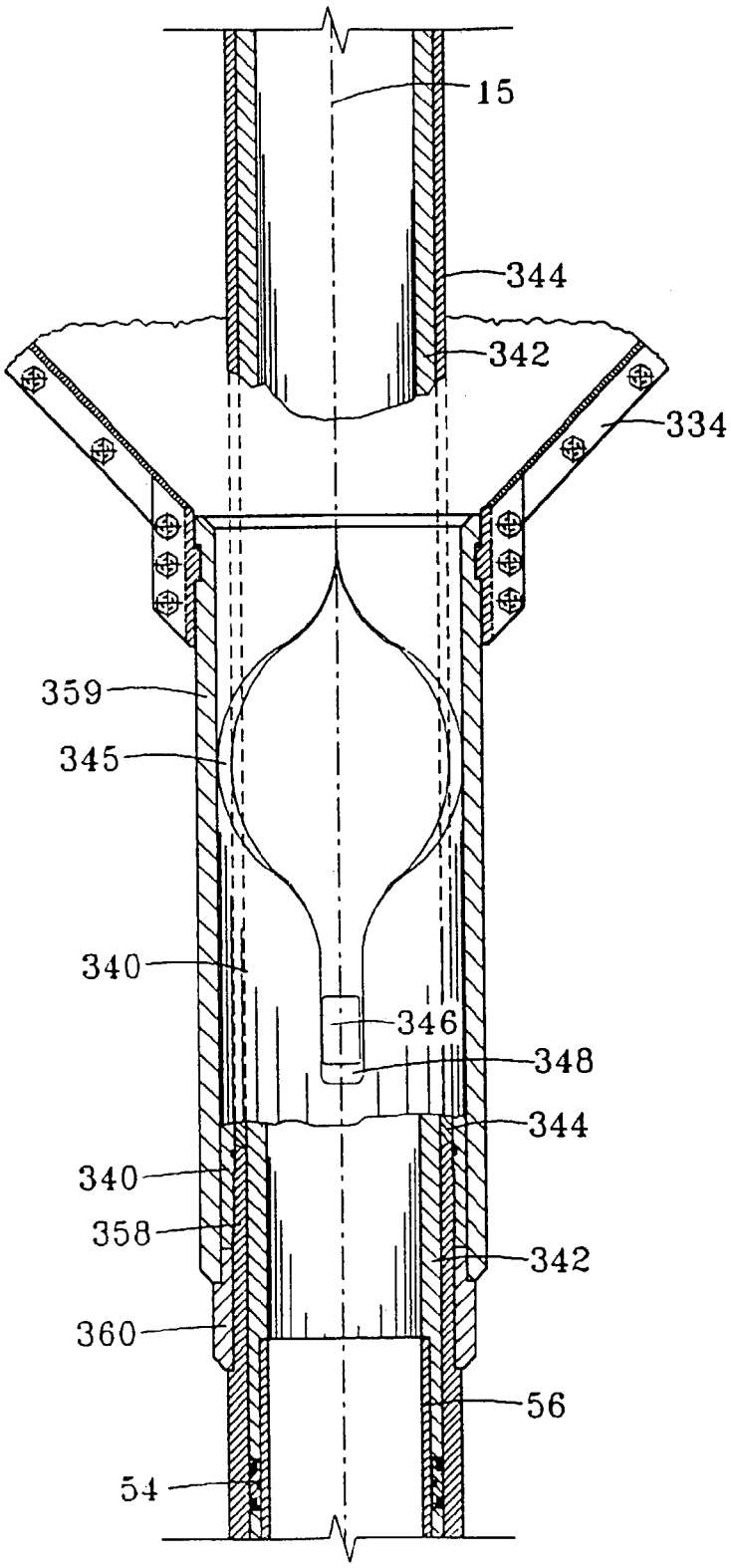
FIG. 18. is a cross-sectional view of a riser disconnect embodiment including a non-rotational key engagement head which is engaged with a non-rotational key.

An alternative embodiment for a riser disconnect may include an apparatus to facilitate rotating an upper riser, a riser disconnect and a lower riser, substantially in unison to drill the lower riser into position in the sea bed. A bit 39 or under reamer bit may be positioned near the lower end of the lower riser 28. Referring to FIG. 18, a tubular, generally female, non-rotational key engagement head 340 may be secured to a female riser disconnect member to receive and engage a non-rotational key member 346. The non-rotational key member 346 may be secured to an outer surface of a mandrel, such as a lockout sleeve 344, which may be concentrically disposed around an upper seal mandrel 342. The female non-rotational key engagement head 340 may include a tapered upper surface, which may be referred to as an upper key guide surface 345, to guide insertion of the male member into non-rotational engagement with the female disconnect member. An extension mandrel 359 may support the female non-rotational key engagement head 340 and may support an entry guide 334. An upper end of a seal bore receptacle 358 may connect with the lower end of the extension mandrel 359. An extension mandrel adapter ring 360 may connect the seal bore receptacle 358 and the extension mandrel 359. Such embodiment may facilitate rotating a lower riser with an upper riser which may be connected by a riser disconnect 10. The non-rotational key engagement head 340 and non-rotational key member 346 components, or variations thereof such components, may be employed for purposes other than drilling in the lower riser 28, such as rotating the lower riser in preparation for and/or during cementing operations, or to rotationally manipulate the lower riser 28 and/or upper riser 35.

Riser Disconnect, General Operation

Referring to FIGS. 1, 2, 2A, 3, 3A, 4, 5 and 5A, the riser disconnect assembly 10, is generally operable by axial motion of the attached upper riser 35 relative to the lower riser 28, using the drilling rig DR to effect axial motion or reciprocation. The male disconnect member 12 is latched into engagement with the female disconnect member prior to riser installation. When the riser disconnect assembly 10 is installed on a well as part of a riser assembly and in the connected and latched position, the upper riser 35 and lower riser 28 are normally under a tensile load, typically around one-hundred thousand pounds of force, between the drilling rig DR and the well casing 32 that extends into the wellbore WB and is cemented therein. The tapered portion or collet engaging ring 81 is circumferentially spaced between the inside of the plurality of collet dogs 78 and the outer surface of the latch mandrel 62, causing the collet dogs to be engaged in the collet groove 82. The tensile load on the male disconnect member 12 is carried through the collet locking sleeve 80 into the collet dogs 78 as a compressive load, through engagement of the collet locking sleeve 80 with the collet dogs 78. The compressive load in the collet dogs 78 is transferred to the female disconnect member 18 through the engagement of the collet dogs 78 with the collet groove 82, the collet groove 82 being a component of the female disconnect member 18. In such riser tensile load configuration, the latch pin 74 is in a latched position 66 within the latch J-slot groove 63. A load bearing shoulder at bottom of the collet dog 78 may be supported on load bearing shoulder at lower end of collet engaging ring 81 of collet locking sleeve 80 when the riser disconnect assembly 10 is in the latched position. A load bearing shoulder at top of the collet dog 78 may be supported on load bearing shoulder at upper end of a collet engagement groove 82 when riser disconnect assembly 10 is in the latched position.

The load bearing lockout shoulders 45 of each riser disconnect lockout pin 46 are preferably normally positioned within the circular, lower portion of the respective lockout groove 43 and in a rotational orientation such that a long axis between the rounded end portions 47 of the lockout pin 46 may be axially aligned parallel to a long axis of the lockout groove 43. In such orientation, the male disconnect member 12 may be unlatched from the female disconnect member 18. Tensile load in the upper riser 35 may not act directly upon the riser disconnect lockout pin 46. When in the locked orientation, the lockout pin 46 may prevent any compressive forces in the riser from inadvertently unlocking the riser disconnect assembly 10, in that the load bearing shoulders 45 are not aligned to move along the lockout grooves 43, as is otherwise required to disconnect the riser disconnect assembly 10. The locked orientation may normally be used only in initial installation of the casing 32, riser disconnect assembly 10. Otherwise the lockout pin 46 will typically remain in the unlocked orientation.

When the riser disconnect lockout 50 is in the locked position, as illustrated in the left half of FIG. 5, compressive forces in the upper riser 35 prohibit an unlocking axial movement of the upper riser 35 relative to the lower riser 18. Compressive forces tending to axially move the upper riser 35 relative to the lower riser 28, such as may be experienced during riser installation, will transfer from the upper seal mandrel 42 to the load bearing lockout shoulders 45 of the lockout pin 46, and from the lockout pin 46 to the riser disconnect lockout housing 48. When applying compressive forces substantially at the riser disconnect assembly 10, the riser disconnect lockout housing 48 will compressingly engage an upper portion of the lockout sleeve 44, which in turn will compressingly engage an upper portion of the seal bore receptacle 54. The seal bore receptacle 54 is an immovable component of the lower riser 28. If the lockout pin is in the unlocked orientation, axial movement of the upper riser 35 relative to the lower riser 28 will result, thereby permitting disconnecting the riser disconnect assembly 10. If the lockout pin 46 is in the locked orientation, substantially no axial movement of the upper riser 35 relative to the lower riser 28 will result, thereby preventing inadvertent disconnecting of the riser disconnect assembly 10. The lockout pin 46 is preferably in the locked orientation during running and installation of the casing 32, the lower riser 28 and upper riser 35. After cementing operations are complete and tension is applied to the riser disconnect assembly 10, a remotely operated vehicle (ROV), diver or other means may be employed to orient the disconnect lockout pin 46 to the unlocked orientation. Well operations may normally be carried on with the riser disconnect lockout 50 in the unlocked orientation.

Riser Disconnect, Unlatching and Disconnecting Operation

In the embodiment illustrated in FIGS. 1, 2, 2A, 3, 3A, 4, 5 and 5A, to unlatch and disconnect the upper riser 35 from the lower riser 28, the tensile load in the riser assembly may be relaxed and converted to a compressive load at the riser interconnection device 40. If the lockout pin 46 is oriented in the locked position the riser disconnect lockout 50 must be unlocked, such as by ROV or diver, before the riser disconnect operation may be performed. The load bearing shoulders 45 of each riser disconnect lockout pin 46, which are positioned within the circular, lower portion of the respective lockout groove 43, may be rotated 90 degrees to a rotational orientation where the long axis portion of the lockout pin 46 providing the load bearing shoulders 47, is aligned parallel to the long axis of each respective lockout groove 43. When the riser disconnect lockout pin 46 is oriented in the unlocked position, axial downward displacement of the upper seal mandrel 42 relative to the lockout sleeve 44 is permitted, such that each lockout groove 43 in the upper seal mandrel 42 may axially move along the respective lockout pin 46 during the axial disconnect movement of the upper riser 35.

As the upper riser 35 is axially moved downward, the male disconnect member 12 moves downward within the female disconnect member 18. Such displacement results in relative movement of the latch J-slot groove downward along the latch pins 74. As downward movement continues, the latch pins 74 move from the latched position 66 in the latch J-slot groove 63 to the collet disengage position 64, and the collet latch sleeve 72, the latch pin 74, the plurality of collet arms 76 and the collet dogs 78 move axially and rotationally to the collet disengage position 64. As the latch mandrel 62 and connected collet locking sleeve 80 move downward, the tapered portion or collet engaging ring 81 of the collet locking sleeve 80 is moved downward and out from between the collet dogs 78 and latch mandrel 62. The collet dogs 78 may thereby move radially inward toward the latch mandrel 62 and out of engagement with the collet groove 82. At that point, the male disconnect member 12 is unlatched from the female disconnect member 18, but is not disconnected.

To disconnect the male disconnect member 12 from the female disconnect member 18, an axial tensile force is applied by the drilling rig DR or other means, to the upper riser 35. As the upper riser 35 moves upward relative to the lower riser 28, the J-slot groove 63 in the latch mandrel 62 moves upward relative to latch pins 74, from the collet disengage position 64 to the latch disconnect position 68. Because the latch disconnect position 68 is relatively higher than the latch connect position 66, the collet latch sleeve 72 and collet dogs 78 are prohibited from moving downward along the outer surface of the latch mandrel 62 sufficiently to permit the collet dogs 78 to engage the collet locking sleeve 80. Thereby, during disconnection of the upper riser 35 from the lower riser, the collet dogs remain disengaged in the annulus between the outer surface of the latch mandrel 62 and the inner surface of the seal bore receptacle 58. The components of the male disconnect member 12, including the riser disconnect lockout 50, the upper and lower seal mandrels 42, 56, the seal elements 54, the riser interconnection device 40 and the collet mechanism 60 may be extracted from the seal bore receptacle 58. The upper riser may be suspended from or removed to the drilling rig DR, leaving the lower riser in place on the well casing 32.

Riser Disconnect, Re-Connecting and Latching Operation

In the embodiment illustrated in FIGS. 1, 2, 2A, 3, 3A, 4, 5 and 5A, to reconnect and latch the upper riser 35 to the lower riser 28, the upper riser 35 may be lowered from the drilling rig DR toward the lower riser 28. The male disconnect member 12 should be guided into and through the entry guide 34, to compressively set in the female disconnect member 18.

As the unlocked male disconnect member 12 is axially moved downward through the female disconnect member 18, such displacement results in relative movement of the latch J-slot groove downward from the unlatched or disconnect position 68, along the latch pins 74. As downward movement continues, the latch pins 74 move from the unlatched or disconnect position 68 in the latch J-slot groove 63 to a top position 67, resulting in the collet latch sleeve 72, the latch pins 74, the plurality of collet arms 76 and the collet dogs 78 moving axially and rotationally on the latch mandrel. As the latch mandrel 62 and connected collet locking sleeve 80 move downward, the collet dogs 78 will engage the collet groove 82. The male disconnect member 12 may bottom out on an upset surface 87 in the latch housing sleeve 84.

To re-latch the riser interconnection device 40, tension may be applied to the upper riser 35 from the drilling rig DR, such that the upper riser 35 may begin to move upward relative to the lower riser 28. As the latch mandrel 62 begins moving upward, the latch pins 74 remain alternatively axially immobile, due to the collet dogs 78 engaged within the collet groove 82. The latch J-slot groove 63 will move upward relative to the latch pins 74, repositioning the latch pins 74 from the top position 67 to one of the latch engaged positions 66. As the latch pins 74 approach the latch engaged position 66, the collet locking ring 81 may circumferentially slide between the inside of the collet dogs 78 and the outside of the latch mandrel 62. The collet dogs 78 may thereby move radially outward toward the latch housing sleeve 84, forcing the collet dogs 78 to fully engage the locking groove 82. At that point, the male disconnect member 12 is securely reconnected and latched into the female disconnect member 18. Tension is preferably sustained within the upper riser 35 from the drilling rig DR in order to maintain the riser interconnection properly in the latched position.

The riser disconnect lockout 50 typically remains in the unlocked orientation during drilling operations. In the event it is alternatively desired to lock the riser disconnect lock 50, a remotely operated actuator, diver or other means are used to reorient the riser disconnect lockout pin 46 to a locked position. From the typically unlocked position, the load bearing shoulders 45 of each riser disconnect lockout pin 46, which, (with the riser in tension) are normally positioned within the circular, lower portion of the respective lockout groove 43, may be preferably rotated 90 degrees to a rotational orientation where the long axis of the round portion 47 of the lockout pin 46 which includes the load bearing shoulders 45, is aligned perpendicular to the long axis of each respective lockout groove 43. Such locked orientation of the lockout pins 46 prohibits axial downward displacement of the upper seal mandrel 42 relative to the lockout sleeve 44, thereby locking the riser disconnect in a latched position.

Alternatively, the riser disconnect assembly 10 and lower riser 28 may be drilled into position in the sea bed while the well bore WB which is to accommodate insertion of the lower riser therein is being drilled. This may be accomplished by a number of means known within the industry. The lower riser 28, upper riser 35 and the riser disconnect assembly 10 may be rotated substantially in unison, from the drilling rig DR. Additionally, rotating the lower riser 28 may be desirable in the event a ledge is encountered while installing the lower riser, wherein it may be desired to rotate the lower riser in order to assist insertion of the lower riser in a hole or well bore. An alternative embodiment of a riser disconnect assembly 10 for accomplishing such objectives is illustrated in FIG. 18, and disclosed above.

Alternatively, depending upon water depth, the riser disconnect 10, the lower riser 28 and/or the upper riser 35, or a portion thereof as determined by water depth, may be positioned on the seabed. A string of drill pipe 36, a drill bit 39 and/or an under reamer bit may be deployed through the positioned riser assembly and the drill string 36 may rotate the riser string along with the bit 39 while drilling the lower riser 28 into the seabed. Those skilled in the art of well drilling operations will appreciate that there are a number of other means for drilling in the lower riser 28.

In another alternative embodiment of the riser disconnect assembly 10, the seal elements 54 may be positioned within one or more grooves in the inner wall of the seal bore receptacle 58, as opposed to being carried upon the generally male component, the lower seal mandrel 56. In such alternative configuration, the lower seal mandrel may then provide a generally smooth outer surface for insertion and sealing with the seal elements 54.

Another alternative embodiment may include a riser flex joint (not shown) connected to the male or female component of the riser disconnect assembly 10. The flex joint may be connected in the riser string between one of the riser connector collar 41 and one of the upper riser 35 and the lower riser 28, or between the latch housing sleeve 84 and the other of the upper riser 35 and lower riser 28, depending upon orientation of the riser disconnect assembly 10.

As an alternative to use with floating drilling rigs DR, such as semi-submersibles and drill ships, the subsea riser disconnect may be used with other types of drilling rigs, such as submersibles, drilling barges or jack-up type drilling rigs. In the event the riser disconnect point is sufficiently far above the mud line, when the riser disconnect is disconnected, buoyancy cans (not shown) may be attached to the lower riser below the riser disconnect and above the mud line ML. Other alternative embodiments may provide for employing an embodiment of the riser disconnect assembly on production wells, development wells and wells other than exploratory or test wells.

Riser Valve Assembly

FIGS. 1, 6, 6A, 7, 8 and 9 illustrate a suitable embodiment for a subsea riser valve assembly 20 according to the present embodiment. The subsea riser valve assembly 20 may be used as a stand alone device in a subsea riser installation or may be used in conjunction with the subsea riser disconnect assembly 10. In an installation where the subsea riser valve assembly 20 is employed in conjunction with the subsea riser disconnect assembly 10, the two components may be configured as a common component assembly, as generally illustrated in FIG. 1, or preferably as two separate component assemblies, as generally illustrated in FIGS. 2, 3, 7 and 9. The riser valve assembly 20 may provide a full bore opening when the valve seal element is in the opened position, such that the minimum ID of the through bore of the riser valve assembly 20 is equal to or greater than the ID of one or both of the upper 35 and lower 28 riser. The riser valve assembly 20 may provide a method for isolating the lower riser 28 prior to disconnecting and removing the upper riser 35 from the lower riser 28, and thereby closing in the well bore WB below the riser valve assembly 20.

Those skilled in the are will appreciate that a riser valve 20 is generally a part of a riser system that includes an upper 35 and lower riser 28, and that the riser valve may thereby include components generally having tubular properties, such as a through bore. Additionally, it may be appreciated that the riser valve 20 may include components which may be similar to components found in valves.

In an application wherein the riser valve assembly 20 is a distinctly separate component from the riser disconnect assembly 10, the subsea riser valve assembly 20 may be preferably installed in an upper portion of the lower riser 28. The lower riser 28 may be comprised of well casing 28, which extends downward through a seabed and into the subsea wellbore WB where the lower riser is secured by cementing the lower riser 28 within the wellbore WB. The lower riser 28 may include or may be partially comprised of threaded well casing pipe 32.

Figure 7:
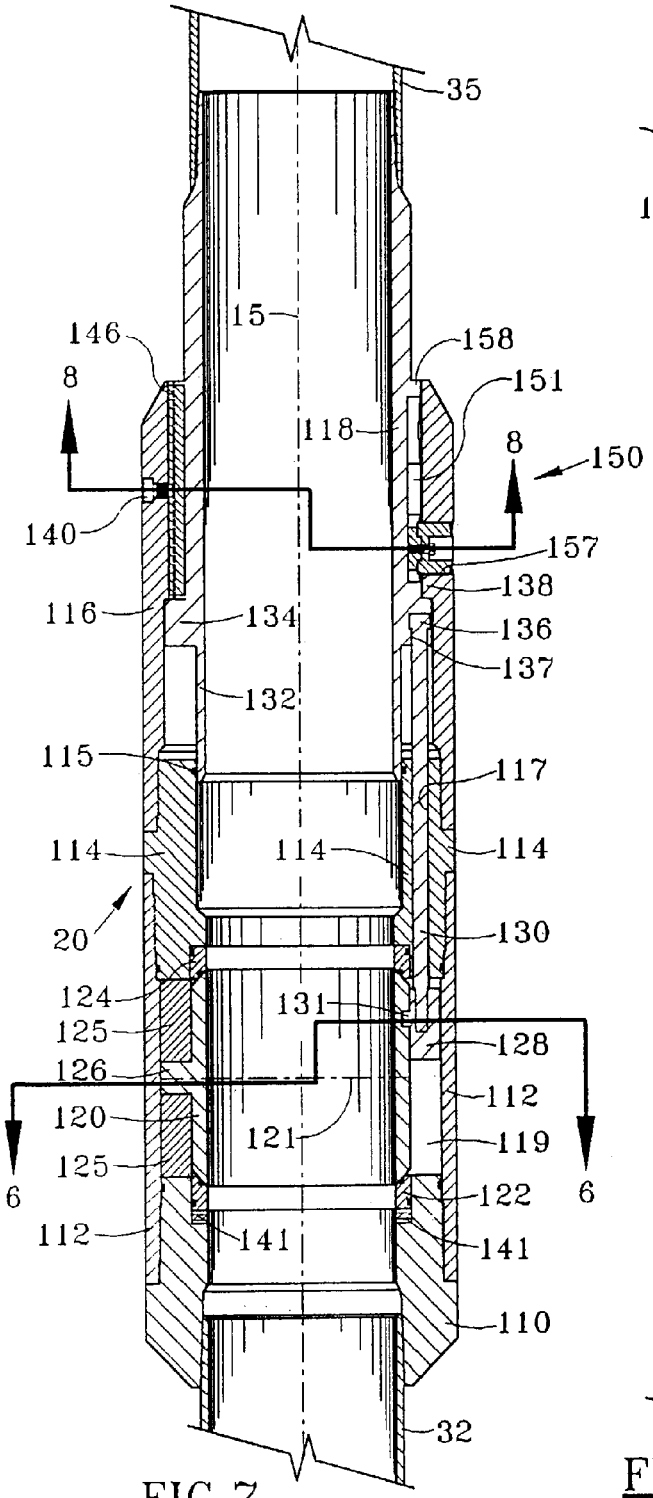
FIG. 7 is a cross-sectional view of a subsea riser valve assembly, with a valve ball in the opened position.
Figure 9:
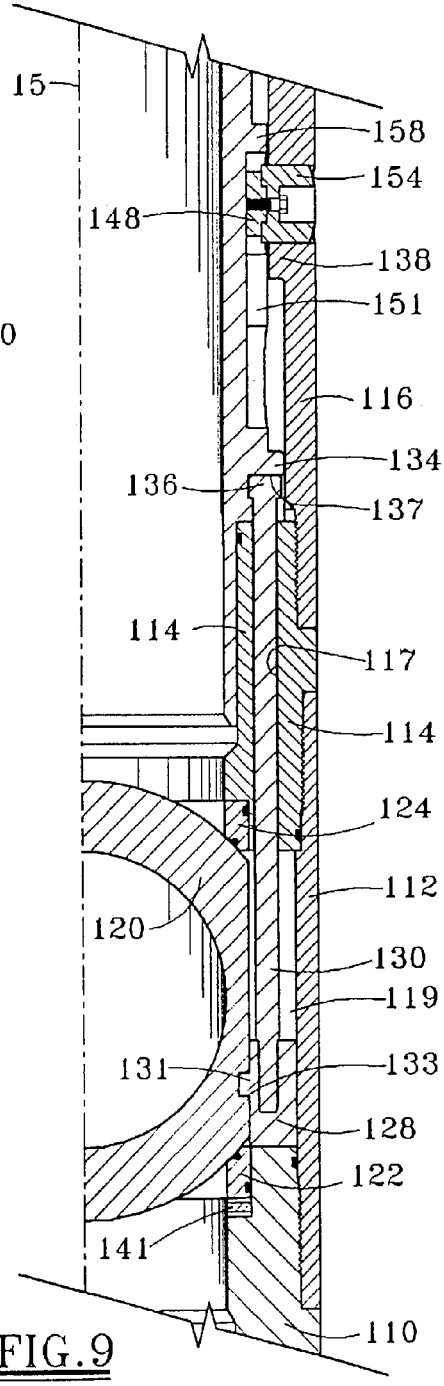
FIG. 9 is an enlarged half-sectional view of a subsea riser valve with a valve ball in a closed position.

The subsea riser valve assembly 20 may include components for selectively closing off the through bore in the lower riser, thereby hydraulically isolating and enclosing the interior of the lower riser 28 and the wellbore WB below the lower riser 28. FIG. 7 illustrates a cross-sectional view of a preferred embodiment for a subsea riser valve assembly 20, with the riser valve assembly 20 in the opened position. FIG. 9 illustrates an enlarged half-section view of the riser valve, with the riser valve assembly 20 in the closed position. A preferred embodiment includes valve housing components 110, 112, 114, and 134, a valve sealing member 120, a valve actuating mandrel 118, and components 128 and 130 which connect the valve actuating mandrel 118 and the valve sealing member 120. The subsea riser valve assembly 20 may be actuated between the valve opened position and the valve closed position by axial movement of the upper riser 35 relative to the lower riser 28, by the drilling rig DR or by other means. The riser valve assembly 20 preferably is designed to fail closed such that tension on the riser assembly and the subsea riser valve assembly 20 is required to maintain the subsea riser valve in an opened position. Thus, under normal operating conditions, the subsea riser valve requires tensile force between the upper and lower ends of the riser valve assembly 20. Releasing the tension or compressing the riser string at the riser valve assembly 20 may preferably result in closure of the riser valve assembly 20.

Referring to FIGS. 1, 6, 6A, 7, 8 and 9, a preferred orientation for the subsea riser valve provides for installing the subsea riser valve assembly 20 with the valve actuating mandrel 118 connected to the upper riser 35 and with a lower valve housing 110 connected to the casing 32 extending below the mud line ML, with the casing 32 comprising a portion of the lower riser 28. In such orientation, a lower end of a lower valve housing 110 may be secured, such as by threaded connection, to an upper end of a well bore casing 32. A lower end of a central valve housing 112 may be secured, such as by threaded connection, to an upper end of the lower valve housing 110. An upper valve housing 114 may be secured to an upper end of the central valve housing 112, while a lower end of a valve mandrel housing 116 may be secured to an upper end of the upper valve housing 114. A lower end of the valve actuating mandrel 118 may telescopically penetrate the upper end of the valve mandrel housing 116 and into an upper end of the upper valve housing 114. An upper end of the valve actuating mandrel 118 may be secured to the lower end of the upper riser 35.

The riser valve assembly 20 includes a valve sealing member 120 that may be actuated in response to movement of the valve actuating mandrel 118. In a preferred embodiment, the valve sealing member 120 is a ball type sealing member, being rotatable about a ball axis 121. Ball pivots 126 may extend along the ball axis 121, from the generally spherically shaped valve sealing member 120 to maintain orientation during rotation of the sealing member 120 between a valve opened position and a valve closed position. The ball type sealing member 120 includes a through bore that provides a generally continuous through bore through the riser assembly and the riser valve assembly 20, when the riser valve is in the valve opened position.

The valve sealing member 120 is generally positioned between the upper 114 and lower 110 valve housings, and within the central valve housing 112. The valve sealing member may move rotationally on the ball pivots 126, which in turn may be mounted within one or more ball mounts for supporting the ball pivots 126 during valve manipulation. The upper portion of the lower valve housing 110 may include a lower valve seat 122 to provide a hydraulic seal between the lower valve housing 110 and the valve sealing member 120. An upper valve seat 124 may be included to provide a hydraulic seal between the upper valve housing 114 and the valve sealing member 120. One or more seat engagement springs 141 may be provided to enhance the hydraulic seal between the valve sealing member 120 and the lower seat 122. Wafer type corrugated springs, or other types of seal enhancement mechanism may be employed to effect seal enhancement.

Figure 6A:
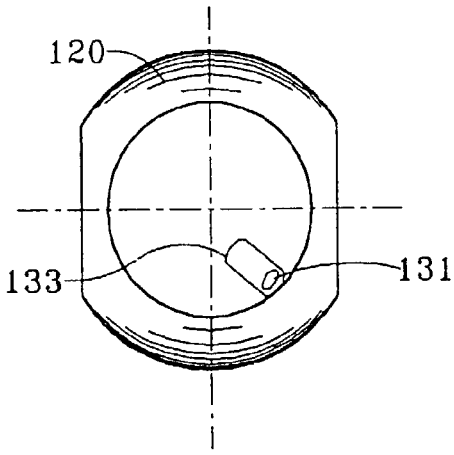
FIG. 6A is a side view of a ball type sealing member shown in FIG. 6, illustrating an engagement groove and engagement pin arrangement.

The valve actuating member 118 may be connected with the valve sealing member 120 with a valve link pin 130 and a link pin adapter 128. The valve actuating mandrel 118 may include an annular support ring 134 with a plurality of valve link sockets 137, preferably two valve link sockets 137, providing one on each side of the actuating member 118. The each respective annular support ring 134 may move axially within one a respective mandrel guide groove 132, within the inner surface of the valve mandrel housing 116. The annular support rings 134 may be connected to an upper end of a valve link pin 130. A retainer 136 may be provided on the upper end of each valve link pin 130 to secure the valve link pin 130 within the its respective valve link socket 137. The valve link pin 130 may extend downward from the annular support ring 134 and penetrate the upper valve housing 114 through an upper valve housing passageway 117, and extend below the upper valve housing 114 to connect with a link pin adapter 128. The link pin adapter 128 may be moveably disposed within the central valve housing 112 to axially reciprocate along a link pin adapter passage 119. The link pin adapter 128 may include a link pin adapter projection 131 to engage the valve seal member 120 in a seal member engagement groove 133, as illustrated in FIG. 6A.

Figure 8:
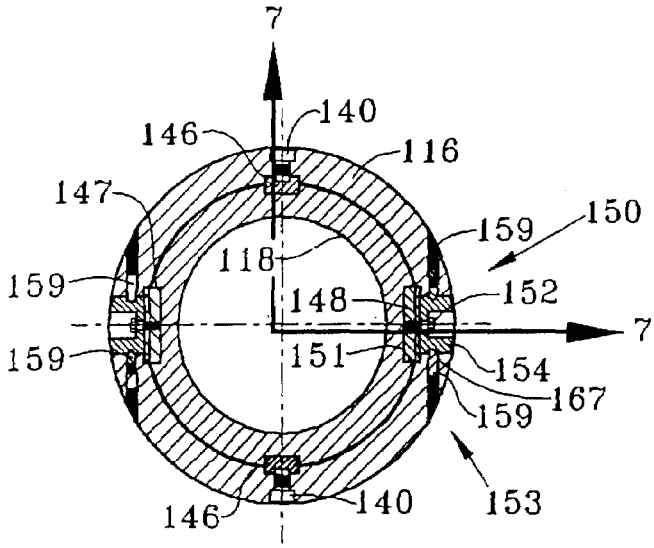
FIG. 8 is a cross-sectional top view of a subsea riser valve assembly illustrating a riser valve lockout device and a valve mandrel guide.

To prevent rotation of the valve actuating mandrel 118 relative to the mandrel housing 116, one or more mandrel guides 146 may be positioned within corresponding grooves provided in both the outer surface of the valve actuating mandrel 118 and the inside surface of the valve mandrel housing 116, as illustrated in FIGS. 7 and 8. The mandrel guides may be secured to the mandrel housing 116 with mandrel guide retainers 140 for each respective mandrel guide 146. The valve actuation mandrel 118 may axially reciprocate along the one or more relatively immovable mandrel guides 146. A preferred embodiment provides two mandrel guides 146 and two mandrel guide retainers 140.

In a preferred embodiment, the riser valve assembly 20 is designed to remain closed until sufficient tension may be applied to the riser valve assembly 20 to actuate the valve sealing member 120 to the opened position. During installation of the riser valve assembly 20, the lack of sufficient tension may prevent the valve sealing member 120 from remaining in the valve opened position. To retain the riser valve in a valve opened position during riser installation, and at any time subsequent to installation, a riser valve lockout assembly 150 may be included. The riser valve lockout assembly 150 may be provided within the valve mandrel housing 116 to act upon the valve actuating mandrel 118 to prevent axial displacement of the valve actuating mandrel 118 relative to the mandrel housing 116. The riser valve assembly 20 may be locked or may remain unlocked, when the valve sealing member 120 is in either the valve opened position or the valve closed position.

Referring to FIGS. 1, 7, 8 and 9, one or more valve lockout grooves 151 may be circumferentially provided on the outer surface of the mandrel housing 116, each lockout groove 151 to accommodate a respective lockout device 153. The combination of a lockout groove 151 plus a lockout device 153 may constitute a lockout assembly 150. The one or more valve lockout grooves 151 may each have a long axis which is aligned axially up and down along the valve actuating mandrel 118, substantially parallel with the central axis 15. Each groove 151 includes a circular portion at the lower end of the groove 151 and at the upper end of the groove 151, each circular portion having a diameter that is larger than the width of the groove 151. The riser valve lockout device 153 is axially moveable along the central axis 15, on the outer surface of the valve actuating mandrel 118.

The riser lockout device 153 may include a lockout pin 148, a lockout pin adapter 154 and a lockout pin connector bolt 152 connecting the lockout pin 148 and the lockout pin adapter 154. The riser lockout pin 148 may be substantially round shaped with a pair of opposing flat sides, such that the round shoulders may provide a pair of upset shoulders 147 on the riser valve lockout pin 148. The round ends of the lockout pin 148 may be axially located along a major linear axis through the lockout pin, the long axis having a length that is longer than the length of a minor axis which extends between the flat sides of the lockout pin 148. The length of the minor axis may be substantially equal to the diameter of the lockout pin adapter 154. Each valve lockout device 153 may extend from inside of a lockout groove 151, outward through a pin port 157 in the valve mandrel housing 116. The rounded end portion 147 of the riser valve lockout device 153 may remain inside of the groove 151 on the outer surface of the riser valve actuating mandrel 118. In an unlocked orientation, the lockout pin adapter 154 may slide in lockout groove 151, along a grooved but non-recessed portion 138 of the valve mandrel housing 116.

As illustrated in FIG. 8, and generally referring to the illustration depicted in FIG. 5A, spring loaded retainer pins 159 may be positioned within the riser valve mandrel housing 116 to engage a retainer groove 167 and/or stop dimple 88 on an outer surface of each lockout pin adapter 154 and may thereby prevent inadvertent rotation of the lockout device 153 and may assist the ROV, diver or other actuator in properly aligning the upset shoulders 147 on the lockout pin 148 with respect to the lockout groove 151. The retainer groove 167 and/or stop dimple 88 may only be provided circumferentially around a portion of the outer surface of the lockout pin adapter 154, such as substantially ninety degree portions of the lockout pin adapter 154.

The riser valve lockout assembly 150 functions similar to the riser disconnect lockout disclosed above. As lockout pin 148 is rotated, such as by ROV or diver, within one of the upper or lower circular portions of the lockout groove 151 to the valve locked orientation, the upset shoulders 147 are oriented so as not to be axially moveable through the narrow portion of the lockout groove 151. The resulting inability of the lockout device 153 to move axially along the lockout groove 151 provides the capability to lock the valve 20 in either a valve opened or valve closed position, depending upon whether the lockout device 153 is engaged in the upper or lower circular portion, respectively, of the lockout groove 151. This assembly may provide the ability to install the riser valve assembly 20 in either a valve opened or a valve closed position.

In an alternative embodiment, a valve sealing member may be generally positioned within a valve housing which includes component variations from a valve housing discussed above that includes the upper 114 and lower 110 valve housings, and the central valve housing 112. In an alternative embodiment, a central valve housing may be included as an integral portion of a lower valve housing or an upper valve housing.

Riser Valve Operation

The subsea riser valve assembly 20 is preferably an independent, stand-alone device which may be inter-connected with numerous other devices or related riser components, such as the riser disconnect, a riser flex joint, or other subsea equipment. The riser valve assembly 20 is preferably installed in tandem with the riser disconnect assembly 10, such that the riser disconnect is positioned axially above the riser valve assembly 20. Both assemblies, 10, 20, are generally inter-connnectably and operationally compatible, as both may be actuated through application and/or reduction of axial tensile force. FIG. 1 generally illustrates a preferred embodiment for a riser valve assembly 20 installation.

A subsea riser valve assembly 20 as illustrated in FIGS. 1, 6, 7, 8 and 9, may be actuated through riser axial reciprocation at the drilling rig DR. The lower valve housing 110 of the riser valve assembly 20 may be connected to the upper end of a lower riser 28. The lower riser 28 may be comprised of one or more joints of well casing pipe 32 of sufficient length that the lower riser 32 may be positioned within a well bore WB such that an upper portion of the lower riser 28 and the riser valve assembly 20 remain externally accessible above the mud line ML to an ROV, actuator or diver, e.g., to lock or unlock the valve lockout assembly 150. The upper end of the valve actuating mandrel 118 may be directly or indirectly secured to the upper riser 35, which extends substantially from the riser valve assembly 20 to the drilling rig DR.

The riser valve assembly 20 is preferably actuated to mechanically fail closed and to remain in the valve closed position, in the absence of a tensile force applied to the riser valve assembly 20 to maintain the riser valve assembly 20 in the opened position. During installation, the riser valve assembly 20 may be positioned in the valve opened orientation and the lockout device 153 rotated to the locked position, within the lower circular portion of the lockout groove 151, to allow fluid to fill the upper 35 and lower 28 risers and to facilitate circulation of fluids, slurrys and/or cement through the upper and lower riser.

The lower riser 28 may be anchored within the well bore WB by placing cement in the annulus between the well bore WB and the outer surface of the well casing 32. After the cement hardens, tension may be applied by the drilling rig DR, to the upper riser 35, the riser disconnect assembly 10, the riser valve assembly 20 and the portion of the lower riser 28 that is not cemented in the well bore WB. When tension is applied to the subsea riser valve assembly 20, the valve lockout device may be rotated to the valve unlocked position. The riser lockout device 153 preferably remains rotationally oriented in the unlocked position during drilling and well work operations, such that the riser valve assembly 20 may be closed within a relatively short period of time by releasing tension in the upper riser 35.

Referring to FIGS. 6, 6A, 7, 8 and 9, during riser valve assembly 20 closing operations, as tension is released in the upper riser 35 the weight of the upper riser 35 may provide an axially downward force acting upon an upper portion of the valve actuation mandrel 118. The downward compressive forces acting upon the valve actuation mandrel 118 may cause the valve actuation mandrel 118 to telescopically move downward within the valve mandrel housing 116 and the upper valve housing 114. Downward movement of the actuation mandrel 118 may be limited by interference between the top of the valve lockout groove 158 and the valve lockout device 153.

The link pin adapter projection 131 on the link pin adapter 128, which is secured to the lower end of the valve link pin 130, is moveably engaged with the valve sealing member 120. As the valve link pin 130 moves downward, the link pin adapter projection 131 may act generally tangentially upon the valve sealing member 120 to effect rotation of the valve sealing member 120 from an opened position to a closed position. The mere weight of components above the riser valve assembly 20, in the absence of tension in the upper riser 35, may provide a "fail closed" biasing effect to the sealing member 120. In an alternative embodiment of a riser valve assembly 20, a separate and/or additional biasing force may be provided, such as a spring, which may also contribute to closing the riser valve assembly 20. The biasing effect in either the preferred or an alternative embodiment may serve to close the riser valve sealing member 120 on demand or in the event of loss of tensile force, and to maintain the riser valve assembly 20 in a closed position, such as when the upper riser 35 may be separated and removed from the riser valve assembly 20.

To open a preferred embodiment of the riser valve assembly 20, tensile force may be applied to the valve actuation mandrel 118. As the valve actuation mandrel 118 is telescopically extended from within the upper valve housing 114 and the valve mandrel housing 116, the link pin 130 and link pin adapter 128, which connect the valve actuation mandrel 118 and the valve sealing member 120, engage the valve sealing member 120 to cause the valve sealing member 120 to rotate from the valve closed position to the valve opened position. A lower valve seat 122 may form a hydraulic seal between the moveable valve sealing member 120 and the lower valve housing 110. An upper valve seat 124 may form a hydraulic seal between the moveable valve sealing member 120 and the upper valve housing 114. On O-ring seal 115 may provide a hydraulic seal between the lower end of valve actuation mandrel 118 and the upper valve housing 114.

In an alternative embodiment of a riser valve assembly, the valve sealing member may be of a type other than a ball type sealing member, such as a gate type sealing member, a plug or cylinder type sealing member or a flapper type sealing member. These alternative type of sealing members may require variations and modifications on the linkage apparatuses required to effect valve manipulation between the valve opened position and the valve closed position, by axial motion or reciprocation of the valve actuation mandrel 118.

In other alternative embodiments, the riser valve assembly 20 may be inverted from the preferred embodiment, such that the valve actuation mandrel 118 is secured to the well casing 32 and a valve body, such as the lower valve housing 110, is secured to the upper riser 35. Axial reciprocation of the upper riser 35 would nevertheless effect movement of the valve body relative to the valve actuation mandrel 118, thereby effecting manipulation of the valve sealing member 120 between the valve opened position and the valve closed position.

An alternative embodiment for the subsea riser valve assembly 20 may integrate the subsea riser valve and subsea riser disconnect assembly 10 into a substantially single assembly which includes both components 10, 20. In such assembly, both the subsea riser disconnect assembly 10 and subsea riser valve assembly 20 may share common housing components.

As an alternative to positioning a subsea riser valve assembly 20 substantially adjacent and below a subsea riser disconnect assembly 10, the subsea riser valve may be installed at any point in a riser assembly, including the lower riser 28 and the upper riser 35, where it may be desirable to provide a valve for closing off an interior portion of a riser through bore.

Drill Pipe Disconnect

FIGS. 1, and 10 through 17 illustrate suitable embodiment for a drill pipe disconnect 30 according to the present invention. The drill pipe disconnect 30 may be used offshore and onshore, along a string of drill pipe 36 used in drilling a subterranean well. In an offshore installation, the drill pipe disconnect may be employed in a drilling installation which also employs a riser disconnect assembly 10 and a subsea riser valve assembly 20. In general, the drill pipe disconnect 30 provides a means for selectively disconnecting an upper portion of a drill pipe string 36 from a lower portion of the drill pipe string 36, while leaving the lower portion of the drill pipe string 36, e.g., within the well bore WB being drilled. The drill pipe disconnect 30 also generally includes an interconnection means which provides for rotating the drill pipe string 36 and for axially transmitting tension and compression in the drill pipe string 36, through the drill pipe disconnect 30.

The drill pipe disconnect 30 may be hydraulically or otherwise actuated between latched and unlatched positions. After disconnection of the drill pipe disconnect 30, the drill pipe disconnect 30 may be reconnected, e.g., by hydraulic actuation of the latch mechanism.

In a preferred embodiment, a drill pipe disconnect 30 may be employed in a subsea installation and in conjunction with a subsea riser disconnect assembly 10 and a subsea riser valve assembly 20. The drill pipe disconnect 30 may be secured within the drill pipe string 36 such that when a drill bit 39 or lower end of the drill pipe string 36 is on or near the bottom of the well bore WB, the drill pipe disconnect 30 may be positioned below the subsea riser valve assembly 20 and the riser disconnect assembly 10. In such configuration, the drill pipe string 36 may be disconnected at the drill pipe disconnect 30, and the upper portion of the drill pipe string 36 may be pulled above the subsea riser valve assembly 20 in order that the subsea riser valve assembly 20 may be closed, thereby sealingly isolating the well bore WB and the lower portion of the drill pipe string 36 within the well bore WB.

A preferred embodiment of the drill pipe disconnect 30, as illustrated in FIGS. 10 through 17, provides for male and female interconnection components. In addition, the preferred embodiment provides for a non-rotational engagement mechanism to facilitate rotational strength in the drill pipe disconnect 30, and a collet mechanism for providing axial engagement and disengagement of the male and female interconnection components. The male interconnection component may generally be referred to as the male disconnect member 205, while the female interconnection component may generally be referred to as the female disconnect member 215. Each of the male disconnect member and female disconnect may include a through bore and a central axis 215 which may be a common to the disconnect members when the drill pipe disconnect 30 is connected.

The male disconnect member 205 may be secured to the lower end of an upper portion of drill pipe 236. An upper end of an upper latch sleeve housing 210 may be secured to the lower end of the upper portion of drill pipe 236. The lower end of the upper latch sleeve housing 210 may be secured to the upper end of a male drill pipe disconnect housing 212. A lower end of the male drill pipe disconnect housing 212 may be secured to the upper end of a latch mandrel 222. The lower end of the latch mandrel 222 may include a latch mandrel collet engaging ring 237. (Referring to FIGS. 10 and 17, the latch mandrel collet engagement ring 237 is preferably an integral portion of the latch mandrel 222, which is distinguished with a separate component number (237) and name to assist in clarifying this disclosure.) A latch sleeve 216 may be moveably positioned within the through bore of the male disconnect member 205. The outer surface of the latch sleeve may be moveably engaged with the inner surfaces of each of the upper latch sleeve housing 210, the male drill pipe disconnect housing 212, the latch mandrel 222 and the latch mandrel collet engaging ring 237. The lower end of the latch sleeve 222 may axially extend below the lower end of the latch mandrel collet engaging ring 237, such that the lower end of the latch sleeve 216 defines the lower end of the male disconnect member 205.

A collet mechanism 230 may be included on the male disconnect member 205 for selectively securing and unsecuring the male disconnect member 205 with the female disconnect member 215. The collet mechanism 230 includes a collet ring secured to and circumferentially encompassing a portion of the outer surface of the latch mandrel 222. A plurality of collet fingers 231 may be spaced circumferentially around the latch mandrel 222, with an upper end of each respective collet finger 231 secured to the collet ring 229, and a lower end of each respective collet finger 231 secured to a respective collet dog 232. The plurality of collet dogs 232 may be positioned near the lower end of the latch mandrel 222, and extend inwardly through square windows 237 positioned in latch mandrel 222 to contact outer surface of latch sleeve 216 such that, in a latched position, the collet dogs 232 may engage the female disconnect member 215 in a collet engagement groove 239.

A shear pin retainer ring 218 may be provided radially between the outer surface of the latch sleeve 216 and the inner surface of the male drill pipe disconnect housing 212, and axially below the upper latch sleeve housing 210 and axially above the latch mandrel 222. The shear pin retainer ring 218 may house one or more shear pins 220 which engage both the shear pin retainer ring 218 and the latch sleeve 216 for prohibiting the latch sleeve 216 from axial movement until the shear pins 220 are selectively sheared.

A collet unlatch groove 224 may circumferentially encompass the outer surface of the latch sleeve 216, such that alignment of the collet unlatch groove 224 with the plurality of collet dogs 232 may provide for radially receiving the collet dogs 232 within the unlatch groove to provide for disconnection of the male disconnect member 205 and the female disconnect member 215. An axial position of the latch sleeve 216 wherein the collet unlatch groove 224 on the latch sleeve 216 is aligned with the plurality of collet dogs 232 may generally be referred to as a collet unlatch position. When the collet unlatch groove 224 is not aligned with the collet dogs 232, such that the collet dogs 232 are caused to engage the collet engagement groove 239 of the female disconnect member 215 by an the latch sleeve 216, such axial position of the latch sleeve 216 may generally be referred to as a collet latch position.

When the male disconnect member 205 is engaged with the female disconnect member 215, a male frustoconical surface 244 substantially on the lower end of the latch mandrel collet engaging ring 237 engages a companion female frustoconical surface 234 in the female disconnect member 215. Engagement of the frustoconical surfaces 234, 244 provides compressive load bearing shoulders between the male disconnect member 205 and the female disconnect member 215. Downward axial movement thereafter of the latch sleeve 216 relative to the latch mandrel 222 effects manipulation of the drill pipe disconnect 30 between the collet latch position and the collet unlatch position. During movement of the latch sleeve 216, the latch sleeve may telescopically and sealingly penetrate a lower portion of the through bore of the female drill pipe disconnect housing 228 axially below the female frustoconical surface 234. The inner surface 245 of the lower portion of the through bore of the female drill pipe disconnect housing 228 which receives the latch sleeve 216, in combination with seal 246 may provide a moveable hydraulic seal between the female disconnect housing 228 and the latch sleeve 216.

An upper surface of the latch sleeve 216 may include an unlatching seat for sealing engagement with an unlatching ball 208. Pressurized engagement of the unlatching ball 208 on the unlatching seat may permit shearing of the shear pins 220 and axial downward of movement of the latch sleeve 216 relative to the latch mandrel 222.

The outer surface of the latch sleeve 216 may include a circumferential first shear pin retainer ring groove 260 having a first shear pin retainer upper stop surface 264. The first shear pin retainer ring groove 260 may circumferentially accommodate the shear pin retainer ring 218. The shear pin retainer ring 218 includes an upper retainer ring stop surface 262. After shearing the shear pins 220, axial downward movement of the latch sleeve 216 relative to the latch mandrel 222, from the collet latch position to the collet unlatch position, is halted by interference between the upper retainer ring stop surface 262 and first shear pin retainer ring groove upper stop surface 264. Such interference position of the latch sleeve 216 relative to the latch mandrel 222 may properly align the collet unlatch groove 224 with the collet dogs 232, in the unlatch position, to permit disconnecting the male disconnect member 205 and the female disconnect member 215.

Figure 10:
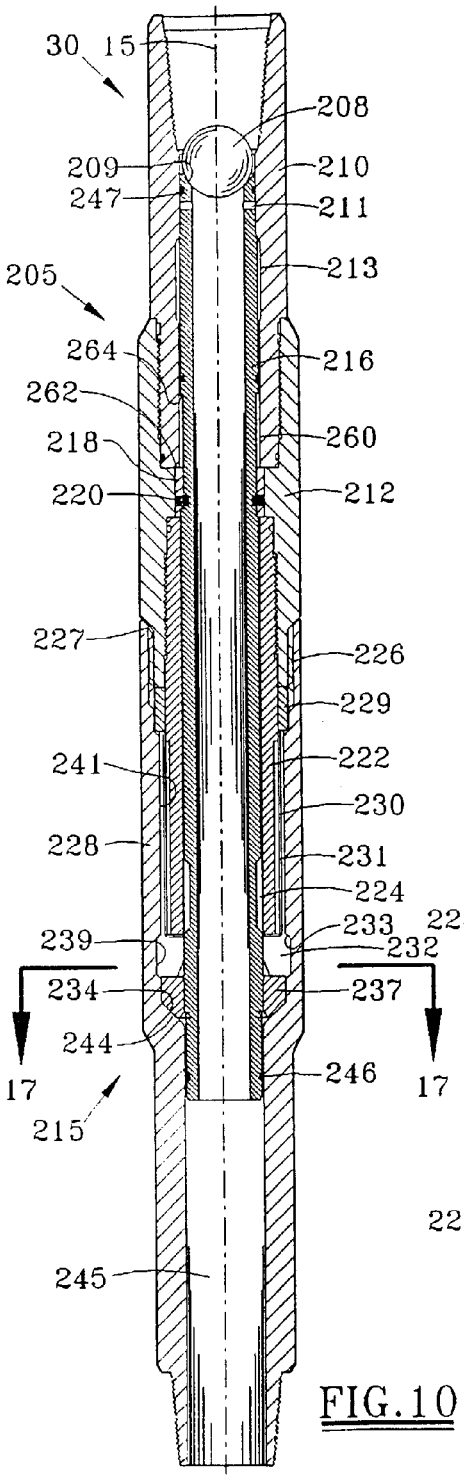
FIG. 10 is a cross-sectional view of a drill pipe disconnect in the collet latched position initially installed, including an unlatching ball.
Figure 11:
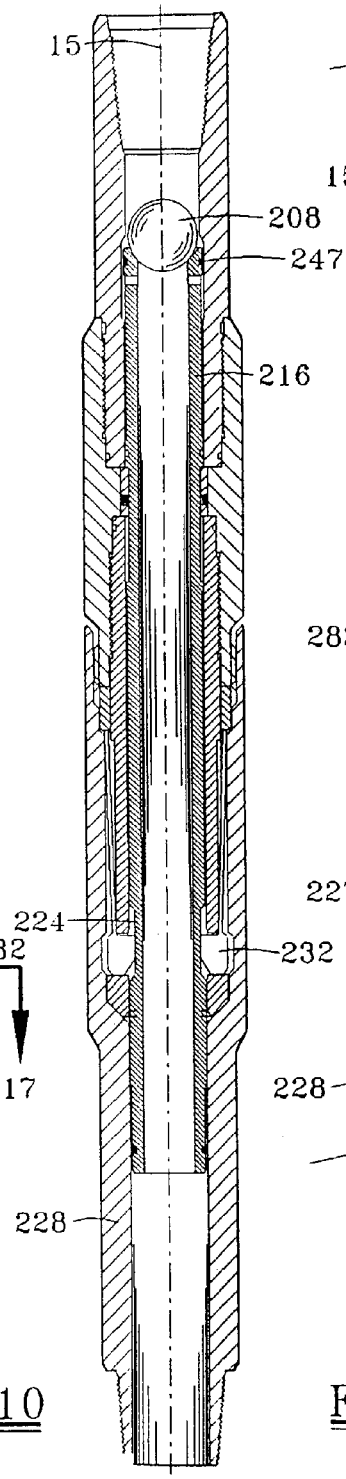
FIG. 11 is a cross-sectional view of the drill pipe disconnect illustrated in FIG. 10, with the latch sleeve moved downward to the collet unlatch position.
Figure 12:
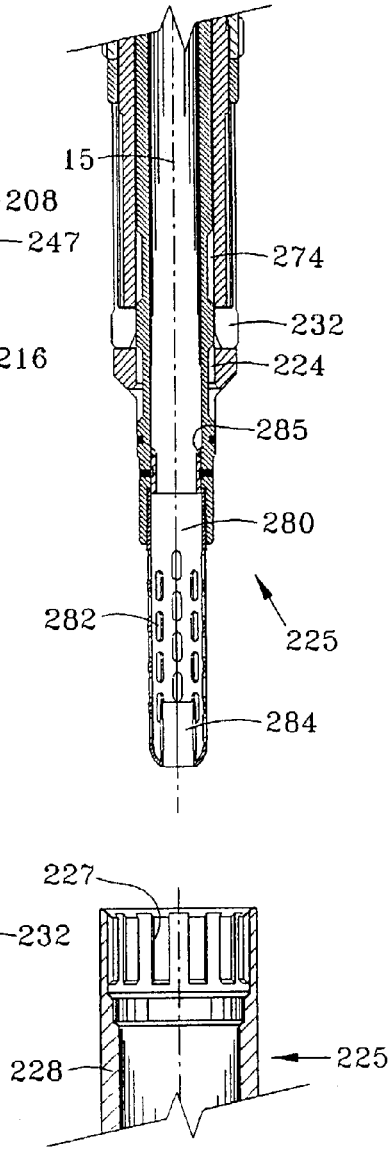
FIG. 12 illustrates a lower end of a second assembly, a male reconnect member separated from the upper end of a female disconnect member, with the female disconnect member illustrating non-rotational engagement grooves.

The female disconnect member 215 may include a receptacle bore 241 for receiving the male disconnect member 205. The collet engagement groove 239 may be positioned circumferentially in an inner wall of the receptacle bore 241. A female non-rotational engagement member 227, as illustrated in FIGS. 10 and 12, may be included with the female disconnect member 215 for engaging a companion male non-rotational engagement member 226, the male non-rotational engagement member 226 being a component secured to the male disconnect member 205. The lower end of the female disconnect member 215 may be engaged with an upper end of the lower portion of drill pipe 240.

Seals 246, 247, packing or other sealing devices may be included to provide hydraulic seals between the male disconnect member 205, male reconnect member 225 and female disconnect member 215, and between the latch sleeve 216, 266 and the upper latch sleeve housing 210. It will be apparent to one skilled in the art that a wide variety of seals and component variations are conceivable and may be applied to apparatus and embodiments of this invention. Consequently, not all seals may be illustrated and/or discussed in this disclosure.

Drill Pipe Disconnect Assembly Configured for Re-Connection and Re-Unlatching

In a preferred embodiment for the drill pipe disconnect 30, when the drill pipe disconnect 30 has been disconnected and the male disconnect member 205 recovered to the drilling rig DR, before reconnecting the male disconnect member 205 with the female disconnect member 215, the male disconnect member 205 may be replaced with a male reconnect member 225. FIGS. 13, 14, 15 and 16 illustrate a preferred embodiment for the redressed male reconnect member 225. The redressed male reconnect member 225 generally includes similar components as the original male disconnect member 205 with the following modifications.

The male drill pipe disconnect housing 212 may be replaced with a male drill pipe disconnect housing 261 which provides ports for insertion of one or more shear pins which may be sheared at two positions on each shear pin (discussed below) or with two separate sets of shear pins. The original latch sleeve 216 is replaced with a latch sleeve 266 that provides an additional collet unlatching groove, referred to as a collet re-unlatching groove 274, circumferentially on the outer surface of the latch sleeve 266 and axially above the original collet unlatch groove 224. The radially raised circumferential surface between the collet unlatch groove 224 and the collet re-unlatch groove 274 may be referred to as the collet latch surface 263. The latch sleeve 266 includes an additional groove 275 substantially adjacent the first shear pin retainer groove 260, the additional groove being referred to as the second shear pin retainer groove 275. The second shear pin retainer groove 275 may be located on the outer surface of the latch sleeve 266, axially between a bottom surface of the shear pin retainer ring 268 and a latch mandrel upper stop surface 270, and may circumferentially encompass the outer surface of the latch sleeve 266. The second shear pin retainer groove 275 may permit movement of the latch sleeve 266 between a collet latch position and a collet re-unlatch position. The shear pin retainer ring 268 may include a port for providing two separate sets of shear pins or a set of double position shear pins 269. The double position shear pin 269 may extend from a series of aligned ports, from the male drill pipe disconnect housing 261 through the shear pin retainer ring 268, and into an annular groove in the outer surface of the latch sleeve 266.

Figure 13:
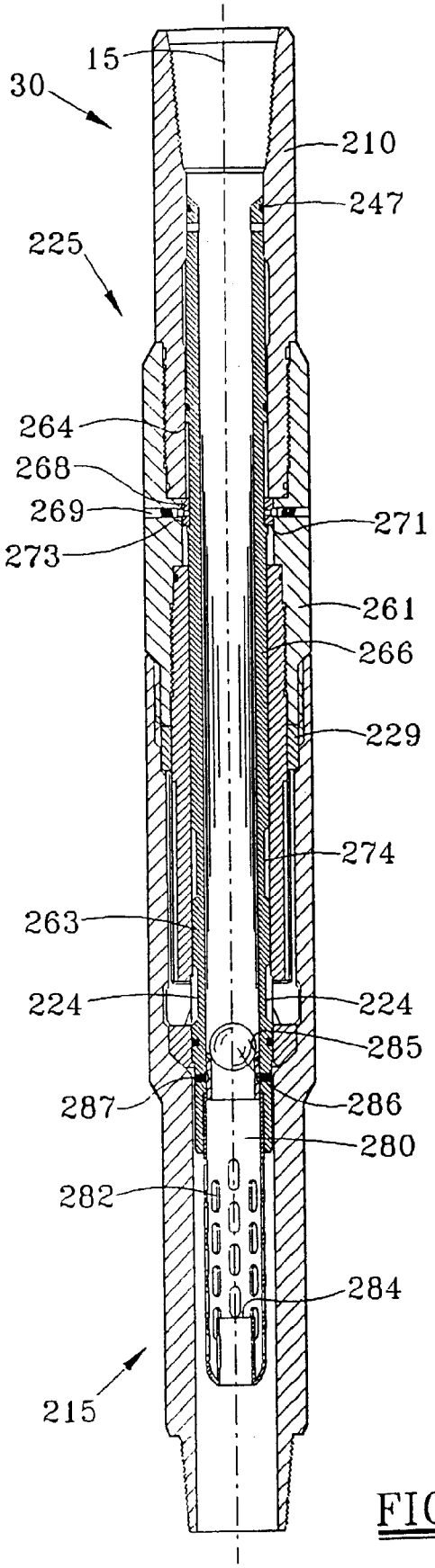
FIG. 13 is a cross-sectional view of a drill pipe disconnect with the second assembly, a male reconnect member engaged with the female disconnect member, in the collet unlatch position with a latching ball seated.

As illustrated in FIG. 13, a latching seat 285 for sealingly seating a latching ball 286 thereon may be included near the lower end of the latching sleeve 266, with the latching seat 285 secured to an inner surface of the latch sleeve 266 in the latch sleeve through bore, with the latching seat 285 secured by one or more latching seat shear pins 287. When latching the male disconnect member 205 with the female disconnect member 215, the latching ball 286 may sealing engage the latching seat 285 in order that the latch sleeve, may axially move from a collet unlatch position to a collet latch position after shearing the first set or the portion of the double shear pin 269 extending through shear pin retainer 268 into the annular groove in the outer surface of the latch sleeve 266. Shearing the one or more latching seat shear pins 287 may provide means for ejection of the latching seat 285 and latching ball 286 from within the latch sleeve 266 after movement of the latch sleeve 266 from the collet unlatch position to the collet latch position.

Figure 16:
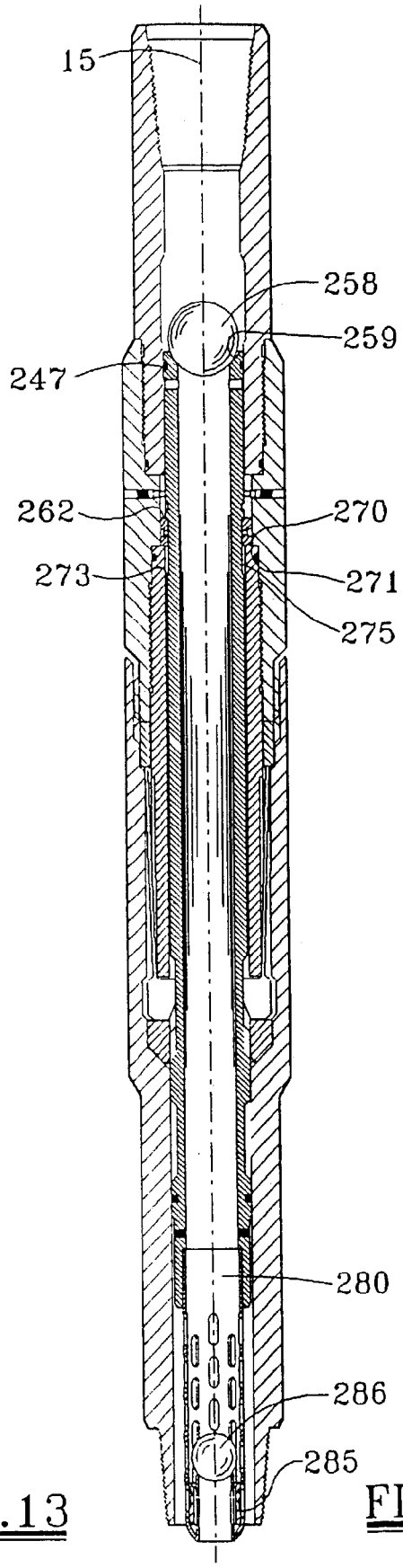
FIG. 16 is a cross-sectional illustration of a drill pipe disconnect with a re-unlatching ball seated and the latch sleeve moved downward to the collet re-unlatch position.
Figure 14:
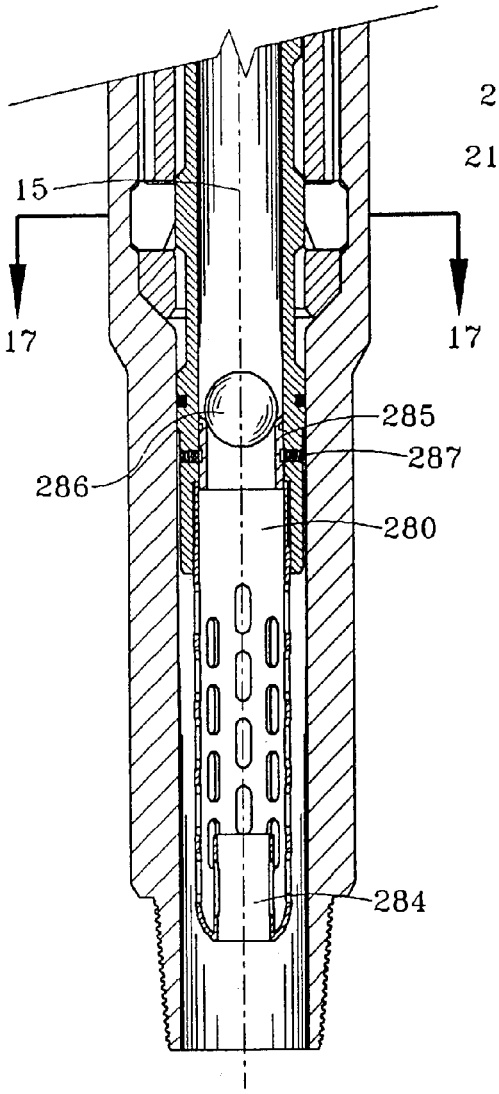
FIG. 14 is an enlarged illustration of the disconnect shown in FIG. 13, with the latch sleeve displaced downward in the collet latch position.
Figure 17:
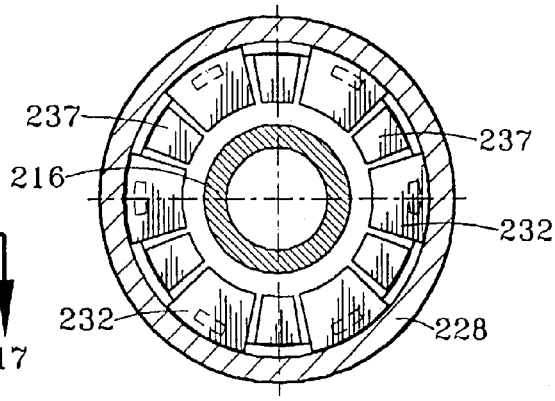
FIG. 17 is a cross-sectional view of a drill pipe disconnect collet mechanism illustrating collet dogs engaged with a female disconnect member and illustrating the fingers connecting the latch mandrel with the collet engagement ring.
Figure 15:
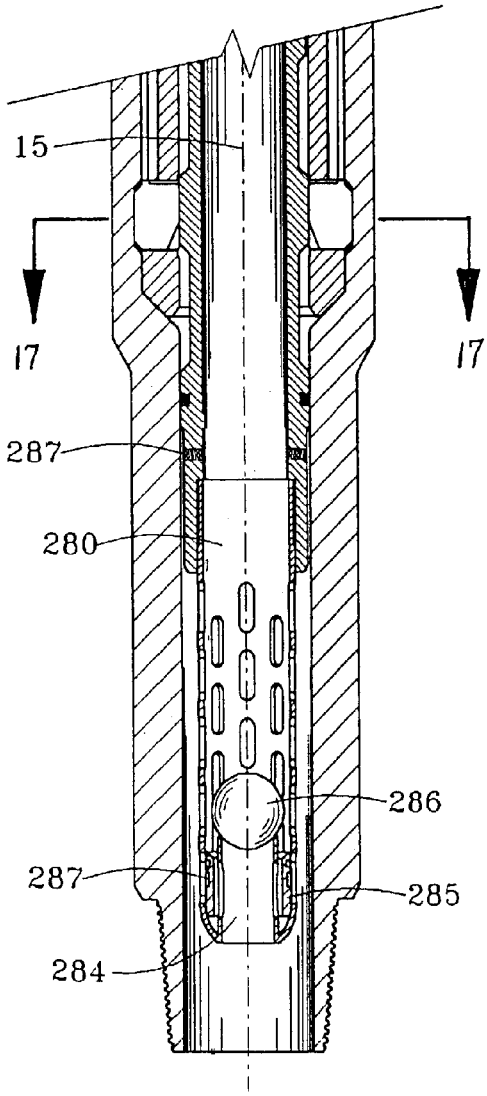
FIG. 15 is an enlarged illustration of a portion of the disconnect shown in FIG. 13, with the latch ball and latch seat ejected into the latch sleeve extension.

The upper end of a latch sleeve extension tube 280 may be secured to the lower end of the latch sleeve 266 to receive and retain the latching seat 285 and latching ball 286 after the latching seat 285 and latching ball 286 are sheared and ejected from within the latch sleeve 266. A plurality of slots or ports 282 may be provided in the latch sleeve extension mandrel 280 to allow circulation of fluid within the through bore of the drill pipe string 36. A ball and seat catcher 284 may be provided near the lower end of the latch sleeve extension tube 280 to catch and retain the ejected latching seat 285 and latching ball 286 within the latch sleeve extension tube 280, as illustrated in FIG. 16.

Alternatively, the latch sleeve 266 may be furnished with an integral non-shearing latching seat 266 and with no latch sleeve extension mandrel 280. When employing this version of a latch sleeve, the latching ball 286 may be flowed to the surface by reverse circulating fluid after shifting the latching sleeve from the unlatch position to the re-latch position.

Drill Pipe Disconnect and Reconnect Operation

Referring to FIGS. 1 and 10 through 16, in the preferred first embodiment for initial installation of the drill pipe disconnect 30, the male disconnect member 205 and female disconnect member 215 may be connected as illustrated in FIG. 10, excluding the unlatching ball 208, and installed in a drill pipe string 36. The latch sleeve 216 may be axially positioned such that the collet dogs 232 are engaged in the collet engagement groove 239, thereby securing the male drill pipe disconnect member 205 with the female drill pipe disconnect member 215. The axial position of the latch sleeve is secured by one or more shear pins 220. The drill pipe disconnect 30 may be positioned at an axial point in the drill string from which it may be desirable to disconnect, such as below a subsurface riser disconnect assembly 10, below a subsurface riser valve assembly 20, or above a trouble spot in a wellbore where it may be desirable to disconnect an upper portion of the drill pipe 236 from a lower portion of the drill pipe 240.

To disconnect the male disconnect member 205 from the female disconnect member 215, the collet mechanism unlatches. Fluid may be circulated through the wellbore WB sufficiently to remove cuttings and other debris. The drill pipe disconnect may be manipulated with the drill pipe set off on bottom, or suspended off bottom in the wellbore by the upper portion of the drill string, thereby allowing the lower disconnected portion of drill pipe to fall subsequent to disconnection. In a preferred embodiment, an unlatching ball 208 may be dropped from the drilling rig DR, through the through bore of the upper portion of drill pipe 236 to sealingly seat on the unlatching seat 209, on a substantially top surface of the latch sleeve 216. Pressure may be applied by the drilling rig DR to the through bore of the upper portion of drill pipe 236 to a first release pressure which creates sufficient axial force upon the latch sleeve 216 to shear pins 220 between male drill pipe disconnect housing 212 and latch sleeve 216 to axially move the latch sleeve downward from a collet latch position to a collet unlatch position. In the collet unlatch position, the plurality of collet dogs 232 may move radially inward within the circumferential collet unlatch groove 224, thereby allowing the male disconnect member 205 to be telescopically removed from the female disconnect member 215.

The upper portion of drill pipe 236 may then be recovered to the drilling rig while leaving the lower portion of drill pipe 240 within the well bore WB. To avoid pulling a "wet string," a drain groove 213 may be provided in the upper portion of the upper latch sleeve housing 210 and one or more drain ports 211 may be provided in the upper portion of the latch sleeve 216 to allow fluid in the upper portion of drill pipe 236 to drain while the upper portion of drill pipe 236 is being removed to the drilling rig DR.

In a subsea installation, a subsea riser valve may be closed above the female disconnect member 215 in order to confine pressure and fluid with the wellbore WB. In addition, a subsea riser disconnect assembly 10 may be disconnected such that the upper riser 35 may be recovered to the drilling rig DR or the rig may be moved with the upper riser suspended below the drilling rig DR.

To reconnect the upper portion of drill pipe 236 with the lower portion of drill pipe 240, the male disconnect member 205 may be replaced or redressed with male reconnect member 225 as described previously. The replaced male reconnect member 225 may be telescopically inserted into the female disconnect member 215, as illustrated in FIG. 13, excluding the latching ball 286. During such insertion, the collet dogs 232 may be recessed into the collet unlatch groove 224 on an outer surface of the latch sleeve 266. The latch sleeve 216 in the male reconnect member 225 may be properly, axially positioned in the unlatch configuration by engagement of upper surface 273 on the outer surface of the latch sleeve 216 and a lower surface of the shear pin retainer 268. During the telescopic insertion of the male reconnect member 225 into the female disconnect member 215, the male non-rotational engagement member 226 may telescopically engage the female non-rotational engagement member 227 to facilitate unitary rotation of the drill pipe string 236, 240.

To latch the male reconnect member 225 with the female disconnect member 215, a latching ball 286 or other closure device, may be dropped or otherwise deployed from the drilling rig DR, through the through bore of the upper portion of drill pipe 236 to sealingly seat on the latching seat 285. Pressure may be applied to the fluid in the through bore of the upper portion of drill pipe 236, upon the latching ball 286 and latching seat 285, to a latching pressure. The latching pressure is sufficient to shear a first shear position on the double position shear pin 269 or first set of separate shear pins, between the latch sleeve and shear pin retainer ring 268. When the first shear position on the double shear position shear pin 269 shears, or the first set of separate shear pins shears, the latch sleeve 266 may axially move downward from the collet unlatch position to the collet latch position. Downward movement of the latch sleeve 266 may be arrested when the first shear pin retainer groove upper stop surface 264 interferes with or engages the upper retainer ring stop surface 262.

At such axial position of the latch sleeve, the collet latch surface 263 on the outer surface of the latch sleeve 266 may engage an inward portion of each collet dog 232, causing each collet dog 232 to remain positioned radially outward and engage the collet unlatch groove 224. The collet dog stop surface 233 engages the collet dogs 232 to prohibit axial separation of the male reconnect member 225 and the female disconnect member 215, and the load bearing shoulder at the bottom of collet dogs 232 may engage a load bearing upper side of the collet engagement ring 237 portion of the latch mandrel 222, thereby securing the male reconnect member 225 with the female disconnect member 215.

After latching the collet mechanism 230, pressure in the upper drill pipe 236 through bore may be further increased from the latching pressure to a ball and seat ejection pressure. The ball and seat ejection pressure may be sufficient to cause the axial downward force upon the latching ball 286 and latching seat 285 to shear the latching seat shear pin 287. When the latching seat shear pin 287 is sheared, the latching seat 285 and latching ball 286 may move axially downward through the through bore in the lower portion of the latch sleeve 266, out of the lower end of the latch sleeve 266, through an upper portion of the latch sleeve extension tube 280 and into a lower portion of the latch sleeve extension tube 280. The ejected latching ball 286 and latching seat 285 may be caught within the lower portion of the latch sleeve extension tube 280 and retained therein by the ball and seat catcher 284. One or more ports 282 through the latch sleeve extension tube 280 may permit transmission of fluid through the drill pipe 36 and drill pipe disconnect 30 through bore, to a bit or other tool on the lower end of the drill pipe 36. As an alternative to shearing the latching seat 285 and latching ball 286 and ejecting the same into latch sleeve extension tube 280, the ball 286 may be recovered to the surface by other means, such as reverse circulating fluid or with tools, prior to shearing the seat 285.

Such configuration thereby represents the normal operating configuration for a preferred embodiment of the drill pipe disconnect 30, after reconnection of the male reconnect member 225 with the female disconnect member 215.

To disconnect the drill pipe disconnect 30 a second time, as illustrated in FIG. 16, a reunlatching ball may be dropped through the through bore in the upper portion of drill pipe 236 for sealingly seating on the re-unlatching seat 259, the re-unlatching seat positioned substantially on an upper surface of the latch sleeve 266. Pressure may be applied in the through bore of the upper portion of drill pipe 236 to a re-unlatching pressure. The re-unlatching pressure may be sufficient to cause the axial downward force on the re-unlatching seat 259 and re-unlatching ball 258 to shear the second set of separate shear pins or the double shear position shear pin at the second shear position. When the second separate set of shear pins or the double shear position shear pin 269 is sheared at the second shear position, the latch sleeve may move axially downward from a collet latch position to a collet re-unlatch position. In the collet re-unlatch position, the collet dogs 232 may be aligned with the collet re-unlatch groove 274 such that the collet dogs may move radially inward toward the latch sleeve 266 and partially recess in the collet re-unlatch groove 224. Downward movement of the latch sleeve may be arrested by engagement of the lower retainer ring stop surface 271 with the latch mandrel upper stop surface 270. The male reconnect member 225 may be telescopically withdrawn from the female disconnect member by axial tensile force at the drilling rig DR, permitting recovery of the upper portion of drill pipe 236 to the drilling rig DR.

Alternative embodiments for the drill pipe disconnect may provide components and means for manipulating components similar to the latch sleeve 216 or 266 other than balls and seats, and hydraulic pressure, such as by mandrel or bars on wire line, or other wireline conveyed tools. Recovery of balls or other manipulating devices may be employed to avoid leaving a ball in the drill pipe disconnect during well drilling or operations, or when pulling the upper portion of drill pipe 236 after disconnecting, to avoid recovering a "wet string." An alternative embodiment functions by dropping a retrievable device to seal on one or more of the seats for manipulation of the latch sleeve 216, 266, which may thereafter be retrieved on wireline to avoid leaving a latching ball in the drill pipe disconnect 30. A dart or standing valve may alternatively be dropped in lieu of a ball. An embodiment may include means for recovering the latching ball after manipulation of the latch sleeve 266, such as with a magnet or by reversing fluid flow to retrieve the ball in a catcher or basket for ball retrieval.

The drill pipe disconnect 30 may be manipulated between latched and unlatched positions, with the drill pipe string 36 set off on bottom of the well bore WB. Also, the drill pipe disconnect 30 may be manipulated between latched and unlatched positions with the drill pipe suspended off of bottom of the well bore WB, in the well bore WB. The weight of the drill pipe suspended below the disconnect may merely require additional hydraulic pressure to disconnect when the drill pipe is suspended off bottom of the well bore WB.

In alternative embodiments for the drill pipe disconnect 30, the collet mechanism may be replaced with a different mechanical or hydraulic latch mechanism, such as a grapple type mechanism. Also, the male disconnect member 205, 225 and female disconnect member 215 may be inverted such that the male disconnect 205, 225 may be secured to the lower portion of drill pipe 240 and the female disconnect member 215 may be secured to the upper portion of drill pipe 236. Alternative embodiments may also be assembled with components which interconnect by means other than generally male and female interconnecting components.

The drill pipe disconnect 30 is generally applicable to drilling wells both onshore and offshore. In addition, although the drill pipe disconnect device is generally referred to herein as a drill pipe disconnect, this device may also be employed with drill pipe used in work over operations, with a "work string" that is generally tubular. The drill pipe disconnect may be positioned below a BOP stack to facilitate disconnecting the drill pipe at a location in the drill string which may be relatively close to the rig, such that subsequently, blind rams may be closed, thereby sealing the interior of the well bore below the BOP stack. Such time saving option may be desirable in a well control situation. Such action may also minimize the amount of pipe that must be tripped out of the well to the rig floor.

The drill pipe disconnect device may be alternatively adapted for use in setting liners or other downhole tubular members wherein it may be desirable to reliably disconnect an upper portion of tubulars from a lower portion of tubulars to leave the lower portion of tubulars within the wellbore.

The disconnect device as disclosed herein may also be usefully employed as a safety device for drilling in high risk environments where the risk of sticking pipe, collapsing a well bore, key-seating the drill pipe in the well bore or other drilling hazard risks losing a lower portion of the pipe in the hole. In such instances, this device may be positioned within the tubular string such that the disconnect device may remain above the hazard point to provide a quick and reliable disconnect point uphole from the hazardous well bore region.

Non-rotational engagement may be alternatively provided by components other than male and female engaging components, such as interlocking keys, dogs or otherwise. Where male and female non-rotational components engaged, the male component may be secured to either the upper portion of drill pipe or to the lower portion of drill pipe, with the female non-rotational engagement component secured to the other of the upper and lower portion of drill pipe.

The drill pipe disconnect may provide the ability to further extend an "extended reach" well bore beyond the point at which all of a drill pipe string may be recovered to the rig by tensional force. In such instance where an open-hole completion may be economically feasible, a lower portion of the drill pipe string may be abandoned within a lower section of the well bore, and the upper portion of the drill string recovered.

An alternative embodiment of the drill pipe disconnect may provide for manipulating a latch sleeve by a mechanism other than hydraulically with balls and seats. A latch sleeve may be manipulated by a standing valve, dart or rod that may sealingly engage a seat for hydraulic manipulation of the latch sleeve. Such standing valve, dart or rod may be recoverable on wireline or otherwise, such as reverse pumping the component out of the drill pipe string. A weight bar or rod may engage a load bearing shoulder with sufficient mass weight force to manipulate the latch sleeve. Alternative embodiments may eliminate the latch sleeve altogether and provide for a collet or other latch and unlatch mechanism which does not require a latch sleeve component to effect engagement of the upper and lower disconnect members.

An embodiment of a drill pipe disconnect may be provided which eliminates the latch seat, latch ball and extension tube, thereby providing an open through bore, through the disconnect tool. Such open through bore may provide access for tools, instruments and materials which would not other wise pass through the ports in the extension tube, to pass through the disconnect device to the lower portion of drill pipe.

Shear pins may be eliminated in favor of other retainer and release components. The drill pipe disconnect may be configured for manipulation between latch and unlatch positions by a combination of axial, rotational and hydraulic forces. Alternative embodiments may also be configured which provide for replacement of each double shear pin with two separate shear pins.

The embodiments described herein and other embodiments of this invention are disclosed in an absence of hydraulic lines between these embodiments and a drilling rig. It is a significant benefit of this invention that hydraulic lines between the rig and downhole assemblies may be omitted. It may be appreciated by one skilled in the art that hydraulic lines may alternatively be provided for various uses or applications, including the disclosed assemblies or embodiments, or with other components or assemblies employed in conjunction with these embodiments. For example, an application for concurrently employing hydraulic lines in conjunction with employment of one or more of the disclosed assemblies may be elected in a shallow water installation, or to provide additional manipulating force to a riser valve sealing member to shear drill pipe. Hydraulic lines are not intended for preclusion from use, however, the disclosed embodiments may provide a more attractive alternative which permits excluding hydraulic lines.

It may be appreciated that various changes to the details of the illustrated embodiments, methods and systems disclosed herein may be made without departing from the spirit of the invention. While preferred embodiments of the present invention have been described and illustrated in detail, it is apparent that still further modifications and adaptations of the preferred and alternative embodiments will occur to those skilled in the art. However, it is to be expressly understood that such modifications and adaptations are within the spirit and scope of the present invention, which is set forth in the following claims.

What is claimed is:

1. A drill pipe disconnect for connecting a lower portion of a drill pipe string with an upper portion of the drill pipe string, the-lower portion of the drill pipe string extending downward from the drill pipe disconnect through a well bore, the upper portion of the drill pipe string extending downward from a drilling rig to the drill pipe disconnect, such that the drill pipe disconnect is selectively actuated to disengage a lower end of the upper portion of the drill pipe string from an upper end of the lower portion of the drill pipe string, the drill pipe disconnect comprising:

a male drill pipe disconnect member having a central axis;

a first drill pipe non-rotational engagement member secured to the male drill pipe disconnect member; and a female drill pipe disconnect member for axially receiving the male drill pipe disconnect member therein, each of the male drill pipe disconnect member and the female drill pipe disconnect member being secured to one of the lower end of the upper portion of the drill pipe string and the upper end of the lower portion of the drill pipe string;

a second drill pipe non-rotational engagement member secured to the female drill pipe disconnect member for non-rotational engagement with the first drill pipe non-rotational engagement member;

a seal for sealing between the male drill pipe disconnect member and the female disconnect member; and a drill pipe interconnection device axially moveable from a latch position for mechanically interconnecting the male drill pipe disconnect member and the female drill pipe disconnect member to an unlatch position for releasing the male drill pipe disconnect member from the female disconnect member.

2. The drill pipe disconnect as defined in claim 1, wherein the interconnection device further comprises:

a collet mechanism for preventing axial separation of the male drill pipe disconnect member and the female drill pipe disconnect member when the collet mechanism is in a collet latch position and for releasing the male drill pipe disconnect member from the female drill pipe disconnect member when the collet mechanism is in a collet unlatch position, the collet mechanism including a collet ring and a plurality of collet fingers extending axially from the collet ring, each collet finger including a collet dog for receipt within a collet engagement groove, the collet fingers and collet dogs moving radially between the collet latch position and the collet unlatch position, the collet engagement groove providing a stop surface for the collet dogs when in the collet latch position, the collet dogs providing a first collet load support shoulders for engaging the collet groove in the female drill pipe disconnect member and a second collet load support shoulder that opposes the first collet load support shoulder, the second collet load support shoulder for engaging a portion of the male drill pipe disconnect member; and the drill pipe latch mandrel for guiding movement of the collet mechanism between the collet latch position and the collet unlatch position.

3. The drill pipe disconnect as defined in claim 2, wherein the drill pipe interconnection device further comprises: a latch sleeve axially moveable from the collet latch position to the collet unlatch position, the latch sleeve having an unlatching seat for seating an unlatching closure device thereon.

4. The drill pipe disconnect as defined in claim 2, wherein the collet mechanism is substantially fixed relative to the latch mandrel when the collet mechanism is in the collet latch position and the collet unlatch position in response to axial movement of the latch sleeve relative to the upper portion of the drill pipe string.

5. The drill pipe disconnect as defined in claim 2, further comprising:

a drill pipe disconnect lockout device for prohibiting inadvertent movement of the latch sleeve from the collet latch position, for preventing inadvertent axial separation of the male drill pipe disconnect member and the female drill pipe disconnect member, to the collet unlatch position to allow axial movement of the male drill pipe disconnect member relative to the female drill pipe disconnect member.

6. The drill pipe disconnect as defined in claim 5, wherein the drill pipe disconnect lockout device includes one or more shear pins extending from a drill pipe disconnect housing to the latch sleeve to prevent movement of the latch sleeve to the collet unlatch position until the shear pins are sheared.

7. The drill pipe disconnect as defined in claim 1, wherein the male drill pipe disconnect member is secured to the lower end of the upper portion of the drill pipe string and the female drill pipe disconnect member is secured to the upper end of the lower portion of the drill pipe string.

8. The drill pipe disconnect as defined in claim 1, further comprising:

a subsea riser disconnect positioned above the drill pipe disconnect to selectively disconnect a lower portion of a subsea riser from an upper portion of a subsea riser at a location above the drill pipe disconnect, such that the male drill pipe disconnect member may be selectively disconnected from the female drill pipe disconnect member before a male subsea riser disconnect member is released from a female subsea riser disconnect member.

9. The drill pipe disconnect as defined in claim 1, further comprising:

a subsea riser valve axially moveable to operate between a valve opened position and a valve closed position, the subsea riser valve relatively positioned above the drill pipe disconnect to seal an interior of a lower riser when the subsea riser valve is in the valve closed position.

10. The drill pipe disconnect as defined in claim 1, wherein the interconnection device further comprises:

a first engagement component secured to one of the male drill pipe disconnect member and the female drill pipe disconnect member;

a second engagement component secured to the other of the male drill pipe disconnect member and the female drill pipe disconnect member; and an axially moveable latch mechanism for selectively and releasably interconnecting the first engagement component and the second engagement component.

11. The drill pipe disconnect as defined in claim 1, further comprising:

a collet mechanism for connecting and disconnecting the male drill pipe disconnect member and the female drill pipe disconnect member when the collet mechanism is in the collet unlatch position and for preventing axial separation of the male drill pipe disconnect member and the female drill pipe disconnect member when the collet mechanism in the collet latch position; and a latch sleeve axially moveable from a collet unlatch position to a collet latch position to a collet re-unlatch position, and the latch sleeve having a seat for sealingly seating a re-unlatching closure device thereon; and a drill pipe latch mandrel for guiding movement of the collet mechanism between the unlatch position, the latch position and the re-unlatch position.

12. The drill pipe disconnect as defined in claim 11, further comprising:

a latching seat carried by the latch sleeve for sealingly seating a latching closure device thereon; and the latching closure device to seat on the latching seat for moving the latch sleeve from the collet unlatch position to the collet latch position when seated on the latching seat.

13. The drill pipe disconnect as defined in claim 11, further comprising:

a latch sleeve extension tube secured to the lower end of the latch sleeve and having one or more fluid circulation ports; and a latching closure device catcher for receiving the latching seat and the latching closure device after the latching seat and latch closure device move from engagement with the latch sleeve to being within the latch sleeve extension tube after the male drill pipe disconnect member is latched to the female drill pipe disconnect member.

14. The drill pipe disconnect as defined in claim 1, wherein one of the first and second drill pipe non-rotational engagement member includes a spline shaft having a through bore and a number of spaced grooves forming a plurality of circumferentially spaced projecting keys, and the other of the first and second drill pipe non-rotational engagement member includes a sleeve having a through bore and a number of spaced internal grooves, such that the first non-rotational engagement member engages the second non-rotational engagement member.

15. A method of connecting and disconnecting a drill pipe disconnect for sealingly engaging a lower portion of a drill pipe string with an upper portion of the drill pipe string, the lower portion of the drill pipe string extending downward from the drill pipe disconnect through a well bore, the upper portion of the drill pipe string extending downward from a drilling rig to the drill pipe disconnect, such that the drill pipe disconnect is selectively actuated to disengage a lower end of the upper portion of the drill pipe string from an upper end of the lower portion of the drill pipe string, the method of connecting and disconnecting the drill pipe disconnect comprising:

attaching a male drill pipe disconnect member to one of the upper portion of the drill pipe string and lower portion of the drill pipe string;

attaching a female drill pipe disconnect member to the other of the upper portion of the drill pipe string and lower portion of the drill pipe string;

securing a first drill pipe non-rotational engagement member to one of the male drill pipe disconnect member and the female drill pipe disconnect member;

securing a second drill pipe non-rotational engagement member to the other of the male drill pipe disconnect member and the female drill pipe disconnect member;

engaging the first drill pipe non-rotational engagement member and the second drill pipe non-rotational engagement member to facilitate rotation of the lower portion of the drill pipe string with the upper portion of the drill pipe string;

mechanically interconnecting the male drill pipe disconnect member and the female drill pipe disconnect member;

sealing between the male drill pipe disconnect member and the female drill pipe disconnect member;

mechanically disengaging the male drill pipe disconnect member from the female drill pipe disconnect member; and pulling the upper drill pipe string at the drilling rig from the lower drill pipe string to separate the upper portion of the drill pipe string from the lower portion of the drill pipe string.

16. The method of connecting and disconnecting a drill pipe disconnect as defined in claim 15, wherein mechanically interconnecting the male drill pipe disconnect member and the female drill pipe disconnect member comprises:

providing a collet mechanism to connect the male drill pipe disconnect member and the female drill pipe disconnect member when in a collet latch position.

17. The method of connecting and disconnecting a drill pipe disconnect as defined in claim 16, wherein mechanically disengaging the male drill pipe disconnect member from the female drill pipe disconnect member comprises:

positioning the collet mechanism to a collet unlatch position to disconnect the male drill pipe disconnect member from the female drill pipe disconnect member.

18. The method of connecting and disconnecting a drill pipe disconnect as defined in claim 16, further comprising:

providing a latch sleeve in one of the male drill pipe disconnect member and the female drill pipe disconnect member;

providing a seat on an upper end of the latch sleeve;

sealingly engaging a closure device on the seat;

axially moving the latch sleeve from the collet latch position to the collet unlatch position with the sealing closure device on the seat; and manipulating the collet mechanism between the collet latch position and the collet unlatch position in response to movement of the latch sleeve.

19. The method of connecting and disconnecting a drill pipe disconnect as defined in claim 15, further comprising:

locking out the latch sleeve to prohibit inadvertent movement of the latch sleeve from (a) the collet latch position to prevent inadvertent axial separation of the male drill pipe disconnect member and the female drill pipe disconnect member, to (b) the collet unlatch position to allow axial movement of the male drill pipe disconnect member relative to the female drill pipe disconnect member.

20. The method of connecting and disconnecting a drill pipe disconnect as defined in claim 19, wherein locking out the latch sleeve includes extending one or more shear pins from a drill pipe disconnect housing to the latch sleeve to prevent movement of the latch sleeve until the shear pins are sheared.

21. The method of connecting and disconnecting a drill pipe disconnect as defined in claim 19, further comprising:

unlocking the latch sleeve by shearing one or more first shear pins to permit movement of the latch sleeve to one of the collet latch and collet unlatch positions; and thereafter shearing one or more second shear pins to permit movement of the latch sleeve from a collet latch position to a collet re-unlatch position.

22. The method of connecting and disconnecting a drill pipe disconnect as defined in claim 15, further comprising:

positioning the drill pipe disconnect below a subsea riser disconnect to selectively disconnect the lower portion of the drill pipe string from the upper portion of the drill pipe string at a position below the subsea riser disconnect, such that the male drill pipe disconnect member may be selectively disconnected from the female drill pipe disconnect member before a male subsea riser disconnect member is released from a female subsea riser disconnect member.

23. The method of connecting and disconnecting a drill pipe disconnect as defined in claim 15, further comprising:

positioning a subsea riser valve above the drill pipe disconnect to seal an interior of the lower 30 riser after the upper drill pipe string is pulled from the lower drill pipe string and at a location above the subsea riser valve, thereby leaving the lower drill pipe string within an interior of the lower riser and the well bore.

24. The method of connecting and disconnecting a drill pipe disconnect as defined in claim 23, further comprising:

locking out the subsea riser valve to prevent inadvertent actuation of the subsea riser valve by preventing axial movement of a valve actuating member.

25. The method of connecting and disconnecting a drill pipe disconnect, as defined in claim 15, further comprising:

positioning the drill pipe disconnect below a blowout preventer for the blowout preventer to seal an interior of the wellbore below the blowout preventer after the upper drill pipe string is pulled from the lower drill pipe string and above the blowout preventer, leaving the lower drill pipe string within the interior of the lower riser and the well bore.

26. The method of connecting and disconnecting a drill pipe disconnect as defined in claim 15, further comprising:

thereafter replacing the male drill pipe disengagement member with a male drill pipe reconnect member to include a latching mandrel secured to the lower end of a latch sleeve, a latching seat, and a latching closure device catcher within the latching mandrel;

positioning a collet mechanism in a collet unlatch position to permit engagement of the male drill pipe disconnect member with the female drill pipe disconnect member;

positioning the latch sleeve in a collet unlatch position to permit the collet mechanism to remain in the unlatch position; and thereafter engaging the male drill pipe disconnect member with the female drill pipe member for reconnecting the upper portion of the drill pipe string with the lower portion of the drill pipe string.

27. The method of connecting and disconnecting a drill pipe disconnect as defined in claim 26, further comprising:

thereafter conveying a latching closure device from the surface, through the through bore in the upper portion of the drill pipe string and through the latch sleeve to sealingly seat the latching closure device in a latch seat on the top of the latch mandrel; and thereafter pressuring up on the interior of the drill pipe string above the latching closure device to shear one or more first shear pins to axially move the latch sleeve to the collet latch position and the collet mechanism to a collet latch position, thereby reconnecting the male drill pipe disconnect member and the female drill pipe disconnect member.

28. The method of connecting and disconnecting a drill pipe disconnect as defined in claim 27, further comprising:

thereafter pressuring up on the interior of the drill pipe string above the latching closure device to move the latching seat and latching closure device from within an upper portion of the latch mandrel to a lower portion of the latch mandrel and catch the latching seat and latching closure device in the latching closure device catcher; and circulating fluid through the interior of the upper portion of the drill pipe string, through the drill pipe disconnect and through the lower portion of the drill pipe string.

29. The method of connecting and disconnecting a drill pipe disconnect as defined in claim 28, further comprising:

thereafter conveying a drill pipe disconnect re-unlatching closure device from the surface through the interior of the upper portion of the drill pipe string;

sealingly seating the re-unlatching closure device in a re-unlatching seat;

pressuring up on the interior of the drill pipe string above the re-unlatching closure device to shear one or more shear pins and axially move the latch sleeve downward from the collet latch position to the collet unlatch position to permit the collet mechanism to unlatch; and thereafter pulling the upper drill pipe string at the drilling rig from the lower drill pipe string to separate the upper drill pipe string from the lower drill pipe string.

30. A drill pipe disconnect for connecting a lower portion of a drill pipe string with an upper portion of the drill pipe string, such that the drill pipe disconnect is selectively actuated to disengage a lower end of the upper portion of the drill pipe string from an upper end of the lower portion of the drill pipe string, the drill pipe disconnect comprising:

a male drill pipe disconnect member;

a first drill pipe non-rotational engagement member secured to the male drill pipe disconnect member; and a female drill pipe disconnect member for axially receiving the male drill pipe disconnect member therein, each of the male drill pipe disconnect member and the female drill pipe disconnect member being secured to one of the lower end of the upper portion of the drill pipe string and the upper end of the lower portion of the drill pipe string;

a second drill pipe non-rotational engagement member secured to the female drill pipe disconnect member for non-rotational engagement with the first drill pipe non-rotational engagement member;

a seal for sealing between the male drill pipe disconnect member and the female disconnect member; and a drill pipe interconnection device moveable from a latch position for mechanically interconnecting the male drill pipe disconnect member and the female drill pipe disconnect member to an unlatch position for releasing the male drill pipe disconnect member from the female disconnect member.

31. The drill pipe disconnect as defined in claim 30, wherein the interconnection device further comprises:

a collet mechanism for preventing axial separation of the male drill pipe disconnect member and the female drill pipe disconnect member when the collet mechanism is in a collet latch position and for releasing the male drill pipe disconnect member from the female drill pipe disconnect member when the collet mechanism is in a collet unlatch position, the collet mechanism including a collet ring and a plurality of collet fingers extending axially from the collet ring, each collet finger including a collet dog for receipt within a collet engagement groove, the collet fingers and collet dogs moving radially between the collet latch position and the collet unlatch position, the collet engagement groove providing a stop surface for the collet dogs when in the collet latch position, the collet dogs providing a first collet load support shoulders for engaging the collet groove in the female drill pipe disconnect member and a second collet load support shoulder that opposes the first collet load support shoulder, the second collet load support shoulder for engaging a portion of the male drill pipe disconnect member; and the drill pipe latch mandrel for guiding movement of the collet mechanism between the collet latch position and the collet unlatch position.

32. The drill pipe disconnect as defined in claim 31, wherein the drill pipe interconnection device further comprises: a latch sleeve axially moveable from the collet latch position to the collet unlatch position, the latch sleeve having an unlatching seat for seating an unlatching closure device thereon.

33. The drill pipe disconnect as defined in claim 31, wherein the collet mechanism is substantially fixed relative to the latch mandrel when the collet mechanism is in the collet latch position and the collet unlatch position in response to axial movement of the latch sleeve relative to the upper portion of the drill pipe string.

34. The drill pipe disconnect as defined in claim 31, further comprising:

a drill pipe disconnect lockout device for prohibiting inadvertent movement of the latch sleeve from the collet latch position, for preventing inadvertent axial separation of the male drill pipe disconnect member and the female drill pipe disconnect member, to the collet unlatch position to allow axial movement of the male drill pipe disconnect member relative to the female drill pipe disconnect member.

35. The drill pipe disconnect as defined in claim 30, wherein the male drill pipe disconnect member is secured to the lower end of the upper portion of the drill pipe string and the female drill pipe disconnect member is secured to the upper end of the lower portion of the drill pipe string.

36. The drill pipe disconnect as defined in claim 30, further comprising:

a subsea riser disconnect positioned above the drill pipe disconnect to selectively disconnect a lower portion of a subsea riser from an upper portion of a subsea riser at a location above the drill pipe disconnect, such that the male drill pipe disconnect member may be selectively disconnected from the female drill pipe disconnect member before a male subsea riser disconnect member is released from a female subsea riser disconnect member.

37. The drill pipe disconnect as defined in claim 30, further comprising:

a subsea riser valve axially moveable to operate between a valve opened position and a valve closed position, the subsea riser valve relatively positioned above the drill pipe disconnect to seal an interior of a lower riser when the subsea riser valve is in the valve closed position.

38. The drill pipe disconnect as defined in claim 30, wherein the interconnection device further comprises:

a first engagement component secured to one of the male drill pipe disconnect member and the female drill pipe disconnect member;

a second engagement component secured to the other of the male drill pipe disconnect member and the female drill pipe disconnect member; and an axially moveable latch mechanism for selectively and releasably interconnecting the first engagement component and the second engagement component.

39. The drill pipe disconnect as defined in claim 30, further comprising:

a collet mechanism for connecting and disconnecting the male drill pipe disconnect member and the female drill pipe disconnect member when the collet mechanism is in the collet unlatch position and for preventing axial separation of the male drill pipe disconnect member and the female drill pipe disconnect member when the collet mechanism in the collet latch position; and a latch sleeve axially moveable from a collet unlatch position to a collet latch position to a collet re-unlatch position, and the latch sleeve having a seat for sealingly seating a re-unlatching closure device thereon; and a drill pipe latch mandrel for guiding movement of the collet mechanism between the unlatch position, the latch position and the re-unlatch position.

40. The drill pipe disconnect as defined in claim 39, further comprising:

a latching seat carried by the latch sleeve for sealingly seating a latching closure device thereon; and the latching closure device to seat on the latching seat for moving the latch sleeve from the collet unlatch position to the collet latch position when seated on the latching seat.

41. The drill pipe disconnect as defined in claim 39, further comprising:

a latch sleeve extension tube secured to the lower end of the latch sleeve and having one or more fluid circulation ports; and a latching closure device catcher for receiving the latching seat and the latching closure device after the latching seat and latch closure device move from engagement with the latch sleeve to being within the latch sleeve extension tube after the male drill pipe disconnect member is latched to the female drill pipe disconnect member.

42. The drill pipe disconnect as defined in claim 30, wherein one of the first and second drill pipe non-rotational engagement member includes a spline shaft having a through bore and a number of spaced grooves forming a plurality of circumferentially spaced projecting keys, and the other of the first and second drill pipe non-rotational engagement member includes a sleeve having a through bore and a number of spaced internal grooves, such that the first non-rotational engagement member engages the second non-rotational engagement member.

43. A method of connecting and disconnecting a drill pipe disconnect for sealingly engaging a lower portion of a drill pipe string with an upper portion of the drill pipe string, such that the drill pipe disconnect is selectively actuated to disengage a lower end of the upper portion of the drill pipe string from an upper end of the lower portion of the drill pipe string, the method of connecting and disconnecting the drill pipe disconnect comprising:

attaching a male drill pipe disconnect member to one of the upper portion of the drill pipe string and lower portion of the drill pipe string;

attaching a female drill pipe disconnect member to the other of the upper portion of the drill pipe string and lower portion of the drill pipe string;

securing a first drill pipe non-rotational engagement member to one of the male drill pipe disconnect member and the female drill pipe disconnect member;

securing a second drill pipe non-rotational engagement member to the other of the male drill pipe disconnect member and the female drill pipe disconnect member;

engaging the first drill pipe non-rotational engagement member and the second drill pipe non-rotational engagement member to facilitate rotation of the lower portion of the drill pipe string with the upper portion of the drill pipe string;

mechanically interconnecting the male drill pipe disconnect member and the female drill pipe disconnect member;

sealing between the male drill pipe disconnect member and the female drill pipe disconnect member; and mechanically disengaging the male drill pipe disconnect member from the female drill pipe disconnect member.

44. The method of connecting and disconnecting a drill pipe disconnect as defined in claim 43, wherein mechanically interconnecting the male drill pipe disconnect member and the female drill pipe disconnect member comprises:

providing a collet mechanism to connect the male drill pipe disconnect member and the female drill pipe disconnect member when in a collet latch position.

45. The method of connecting and disconnecting a drill pipe disconnect as defined in claim 44, further comprising:

providing a latch sleeve in one of the male drill pipe disconnect member and the female drill pipe disconnect member;

providing a seat on an upper end of the latch sleeve;

sealingly engaging a closure device on the seat;

axially moving the latch sleeve from the collet latch position to the collet unlatch position with the sealing closure device on the seat; and manipulating the collet mechanism between the collet latch position and the collet unlatch position in response to movement of the latch sleeve.

46. The method of connecting and disconnecting a drill pipe disconnect as defined in claim 45, further comprising:

locking out the latch sleeve to prohibit inadvertent movement of the latch sleeve from (a) the collet latch position to prevent inadvertent axial separation of the male drill pipe disconnect member and the female drill pipe disconnect member, to (b) the collet unlatch position to allow axial movement of the male drill pipe disconnect member relative to the female drill pipe disconnect member.

47. The method of connecting and disconnecting a drill pipe disconnect as defined in claim 45, further comprising:

positioning the drill pipe disconnect below a subsea riser disconnect to selectively disconnect the lower portion of the drill pipe string from the upper portion of the drill pipe string at a position below the subsea riser disconnect, such that the male drill pipe disconnect member may be selectively disconnected from the female drill pipe disconnect member before a male subsea riser disconnect member is released from a female subsea riser disconnect member.

48. The method of connecting and disconnecting a drill pipe disconnect as defined in claim 43, further comprising:

positioning a subsea riser valve above the drill pipe disconnect to seal an interior of the lower 30 riser after the upper drill pipe string is pulled from the lower drill pipe string and at a location above the subsea riser valve, thereby leaving the lower drill pipe string within an interior of the lower riser and the well bore.

49. The method of connecting and disconnecting a drill pipe disconnect, as defined in claim 43, further comprising:

positioning the drill pipe disconnect below a blowout preventer for the blowout preventer to seal an interior of the wellbore below the blowout preventer after the upper drill pipe string is pulled from the lower drill pipe string and above the blowout preventer, leaving the lower drill pipe string within the interior of the lower riser and the well bore.

50. The method of connecting and disconnecting a drill pipe disconnect as defined in claim 43, further comprising:

thereafter replacing the male drill pipe disengagement member with a male drill pipe reconnect member to include a latching mandrel secured to the lower end of a latch sleeve, a latching seat, and a latching closure device catcher within the latching mandrel;

positioning a collet mechanism in a collet unlatch position to permit engagement of the male drill pipe disconnect member with the female drill pipe disconnect member;

positioning the latch sleeve in a collet unlatch position to permit the collet mechanism to remain in the unlatch position; and thereafter engaging the male drill pipe disconnect member with the female drill pipe member for reconnecting the upper portion of the drill pipe string with the lower portion of the drill pipe string.

* * * * *